US009199790B2

(12) United States Patent
Warren

(10) Patent No.: US 9,199,790 B2
(45) Date of Patent: Dec. 1, 2015

(54) INFLATABLE REFUSE CONTAINERS AND METHODS OF USE

(71) Applicant: William J. Warren, Frisco, TX (US)

(72) Inventor: William J. Warren, Frisco, TX (US)

( * ) Notice: Subject to any disclaimer, the term of this patent is extended or adjusted under 35 U.S.C. 154(b) by 0 days.

(21) Appl. No.: 14/281,175

(22) Filed: May 19, 2014

(65) Prior Publication Data

US 2015/0076145 A1 Mar. 19, 2015

Related U.S. Application Data

(60) Provisional application No. 61/855,695, filed on May 21, 2013.

(51) Int. Cl.
*B65F 1/02* (2006.01)

(52) U.S. Cl.
CPC ..... *B65F 1/02* (2013.01); *B65F 2210/1023* (2013.01); *B65F 2210/132* (2013.01); *B65F 2220/116* (2013.01)

(58) Field of Classification Search
CPC .... B65B 67/12; B65D 81/052; B65D 81/051; B65D 81/05; B65F 1/1415; B65F 1/141; B65F 1/14; B65F 1/0046; B65F 1/004; B65F 1/0033; B65F 1/02
USPC ..... 220/9.4, 4.28, 908, 530, 529; 383/3
See application file for complete search history.

(56) References Cited

U.S. PATENT DOCUMENTS 3,000,185 A * 9/1961 Brinkmann, Jr. ..... 405/226
3,039,120 A 6/1962 Powell et al.
3,044,515 A * 7/1962 Eades ..... 383/3
3,109,184 A 11/1963 Moore, Jr.
3,186,543 A * 6/1965 Minick et al. ..... 206/393
3,204,866 A 9/1965 Brighton et al.
3,241,560 A 3/1966 Willat
3,556,186 A * 1/1971 Besthorne et al. ..... 383/3
3,742,994 A 7/1973 Pensak
3,786,526 A 1/1974 Ausseil
3,913,907 A 10/1975 Baker
4,384,603 A * 5/1983 Tyrer et al. ..... 220/4.23
4,612,781 A 9/1986 Swerdon
4,809,444 A 3/1989 Henderson et al.
4,858,755 A 8/1989 Kuivanen
4,867,576 A 9/1989 Boyd
4,919,290 A * 4/1990 Wadel ..... 220/503
4,941,754 A 7/1990 Murdock
5,011,137 A 4/1991 Murphy
5,102,120 A 4/1992 Lindblad
5,127,523 A * 7/1992 Herdlicka ..... 206/370

(Continued)

FOREIGN PATENT DOCUMENTS

EP 374360 A1 * 6/1990 ..... B65F 1/14
GB 2314004 A * 12/1997 ..... B65F 1/00
WO WO 9501294 1/1995

OTHER PUBLICATIONS

Translation of EP 374360 (Achterberg et al.), Jun. 27, 1990, pp. 3 and 8.*

*Primary Examiner* — Robert J Hicks
(74) *Attorney, Agent, or Firm* — Carr & Ferrell LLP

(57) ABSTRACT

A trash container for holding trash which may include an inflatable frame a front flexible wall connected to the inflatable frame, a back flexible wall connected to the inflatable frame and opposed to the front flexible wall, a pair of side flexible walls connected to the inflatable frame and connected to the front flexible wall and the back flexible wall.

23 Claims, 31 Drawing Sheets

(56) References Cited

U.S. PATENT DOCUMENTS

| | | | | |
|---|---|---|---|---|
| 5,209,364 | A * | 5/1993 | LaPoint, Jr. | 220/4.28 |
| 5,314,250 | A * | 5/1994 | Lee | 383/3 |
| 5,692,833 | A | 12/1997 | DeLuca | |
| 5,735,495 | A | 4/1998 | Kubota | |
| 6,123,217 | A | 9/2000 | Miller | |
| 6,540,647 | B2 | 4/2003 | Spooner et al. | |
| 6,606,880 | B1 | 8/2003 | Carlin et al. | |
| 6,899,581 | B1 | 5/2005 | Nokes | |
| 8,771,150 | B2 | 7/2014 | Warren | |
| 2005/0066562 | A1 * | 3/2005 | Bober et al. | 40/610 |
| 2013/0172158 | A1 | 7/2013 | Warren | |
| 2013/0225061 | A1 | 8/2013 | Warren | |
| 2013/0225062 | A1 | 8/2013 | Warren | |
| 2013/0316883 | A1 | 11/2013 | Warren | |
| 2015/0021333 | A1 | 1/2015 | Warren | |
| 2015/0023613 | A1 | 1/2015 | Warren | |

* cited by examiner

INFLATABLE REFUSE CONTAINERS AND METHODS OF USE

PRIORITY

The present application claims priority under 35 USC section 119 based upon U.S. provisional application Ser. No. 61/855,695 which was filed on May 21, 2013.

FIELD OF THE INVENTION

The present invention relates to trash containers and more particularly to a trash container having flexible walls.

BACKGROUND

Trash is a common problem around the home, office and outdoors. In order to collect this trash, trash cans have been used. However, these trash cans can be small and generally have rigid sidewalls. The rigid sidewalls prevent the trash cans from being flattened out and stored in a relatively small space. What is needed is a trash can which can be easily deployed and easily stored in a limited space.

SUMMARY

A trash container for holding trash may include an inflatable frame, a front flexible wall connected to the inflatable frame, a back flexible wall connected to the inflatable frame and opposed to the front flexible wall and a pair of side flexible walls connected to the inflatable frame and connected to the front flexible wall and the back flexible wall.

The trash container may include a rigid bottom wall.

The trash container may include a tie down strap.

The trash container may include an inflator/deflator device including a valve to inflate and deflate the frame of the trash container.

The trash container may include a release valve.

The trash container may include a cleat.

The bottom wall may be inclined at an angle between 1° and 90° with respect to a support surface.

A bench support system is placed under the inclined wall for a pet.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

Figure 1:
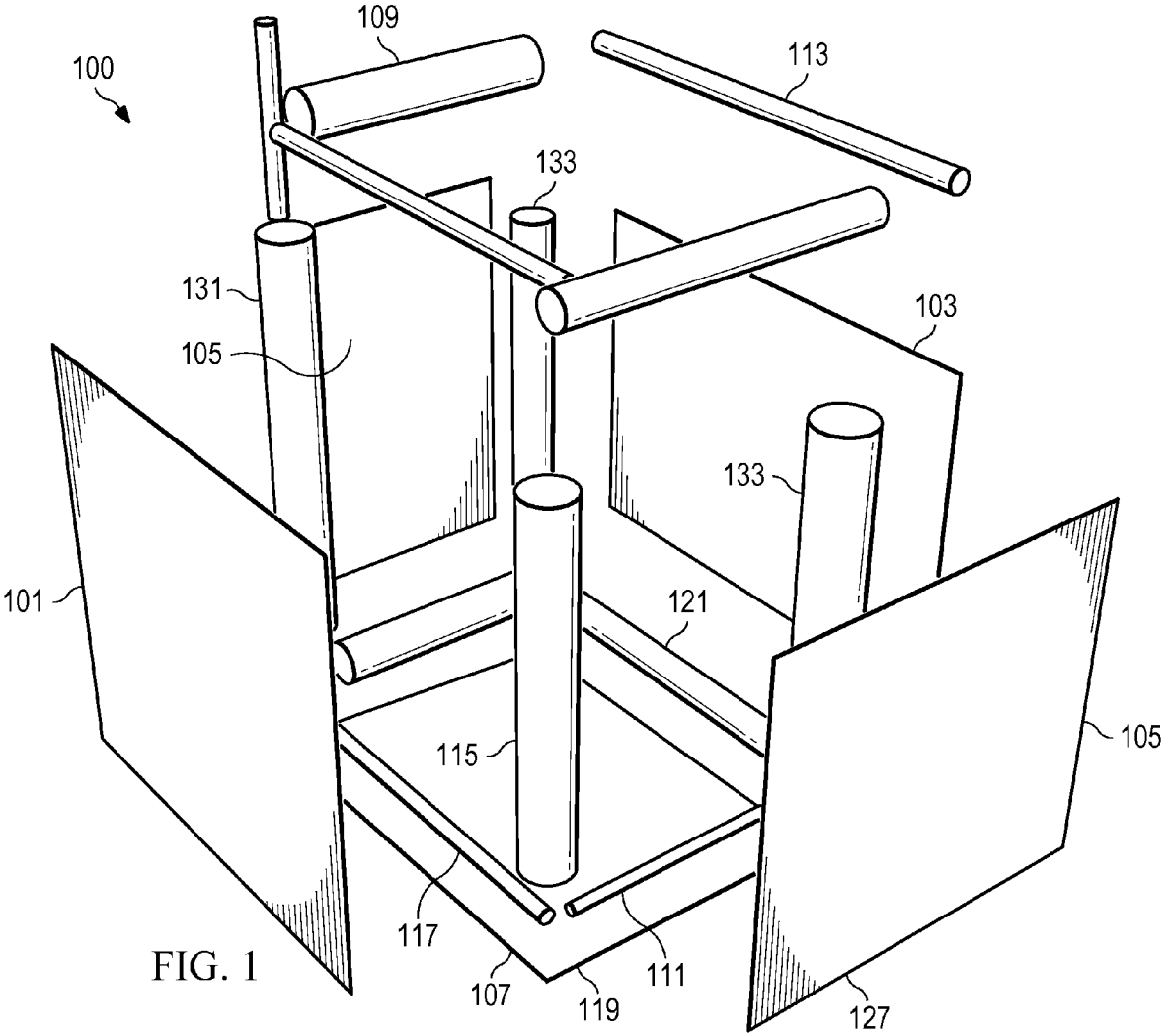
FIG. 1 illustrates an exploded view of the trash container of the present invention, according to an example embodiment.

FIG. 1 illustrates a trash container 100 which may include a front flexible wall 101, a back flexible wall 103, and a pair of side flexible walls. The front flexible wall 101, the back flexible wall 103 and the pair of side flexible walls 105 may be formed from a flexible sheet, which may be a plastic, such as HEFTY, GLAD, or a similar type of material, cloth, a balloon type substance, a woven material polyvinyl material or any other material available. The front flexible wall 101, the back flexible wall 103 and the pair of side flexible walls 105 may be connected to a bottom wall 107 which may be flexible or rigid.

The front flexible wall 101 may be opposed to the back flexible wall 103 and may be connected to the pair of side flexible walls 105, and the back flexible wall may be opposed to the front flexible wall 101 and may be connected to the pair of opposing side walls 105.

The first flexible wall 101, the back flexible wall 103, the pair of side flexible walls 105 and the bottom wall 107 may be connected to a frame 109 which may include a bottom periphery member 111, an opposed top periphery member 113 and a substantially vertical member 115 to connect the bottom periphery member 111 to the top periphery member 113.

The bottom periphery member 111, the top periphery member 113 and the vertical member 115 may be a hollow expandable tube or multiple tubes which may be expanded by fluid pressure such as air and may be returned to the original position (which may be deflated) by the release of the fluid pressure such as air, and each member may be interconnected with at least one other member in order to allow the fluid to flow and pressurize each member simultaneously.

FIG. 1 shows the bottom periphery member 111, the top periphery member 113 and the vertical member 115 which may be optionally a cylinder having a circular cross-section or other appropriate shape.

The bottom periphery member 111 may include a front bottom frame member 117 which may be connected to a side bottom frame member 119 and which may be connected to a first vertical frame member 129 and a second vertical frame member 131 and a back bottom frame member 121 which may be connected to the side bottom frame member 119 and which may be connected to a third vertical frame member 133 and a fourth vertical frame member 135.

Figure 2:
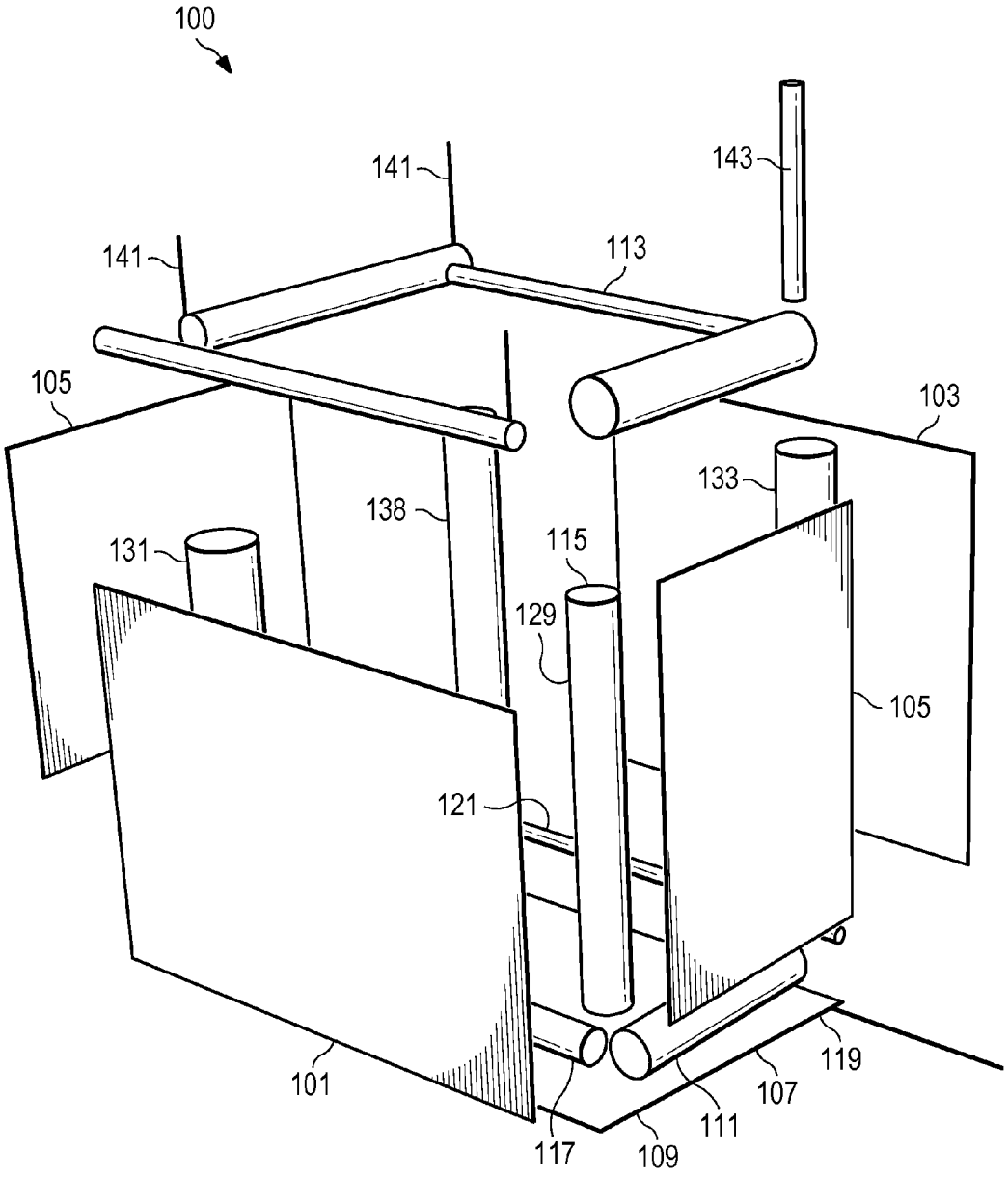
FIG. 2 illustrates an exploded view of the trash container of the present invention, according to an example embodiment.

FIG. 2 illustrates a trash container 100 which may include a front flexible wall 101, a back flexible wall 103, and a pair of side flexible walls. The front flexible wall 101, the back flexible wall 103 and the pair of side flexible walls 105 may be formed from a flexible sheet, which may be a plastic, such as HEFTY, GLAD, or a similar type of material, cloth, a balloon type substance, a woven material polyvinyl material or any material. The front flexible wall 101, the back flexible wall 103 and the pair of side flexible walls 105 may be connected to a bottom wall 107 which may be flexible or rigid.

The front flexible wall 101 may be opposed to the back flexible wall 103 and may be connected to the pair of side flexible walls 105, and the back flexible wall may be opposed to the front flexible wall 101 and may be connected to the pair of opposing side walls 105.

The first flexible wall 101, the back flexible wall 103, the pair of side flexible walls 105 and the bottom wall 107 may be connected to a frame 109 which may include a bottom periphery member 111, an opposed top periphery member 113 and a substantially vertical member 115 to connect the bottom periphery member 111 to the top periphery member 113.

The bottom periphery member 111, the top periphery member 113 and the vertical member 115 may be an hollow expandable tube or multiple tubes which may be expanded by fluid pressure such as air and may be returned to the original position (which may be deflated) by the release of the fluid pressure such as air, and each member may be interconnected with at least one other member in order to allow the fluid to flow and pressurize each member simultaneously.

FIG. 2 shows the bottom periphery member 111, the top periphery member 113 and the vertical member 115 being optionally a cylinder having a circular cross-section or another appropriate shape.

The bottom periphery member 111 may include a front bottom frame member 117 which may be connected to a side bottom frame member 119 and which may be connected to a first vertical frame member 129 and a second vertical frame member 131 and a back bottom frame member 121 which may be connected to the side bottom frame member 119 and which may be connected to a third vertical frame member 133 and a fourth vertical frame member 135.

FIG. 2 additionally illustrates tied down straps 141 to be used to tie down the trash container 100, and FIG. 2 illustrates an inflation/deflation device 143 to allow the frame 109 to be inflated or deflated which may include an adjustable valve to seal an unseal the frame 109.

Figure 3:
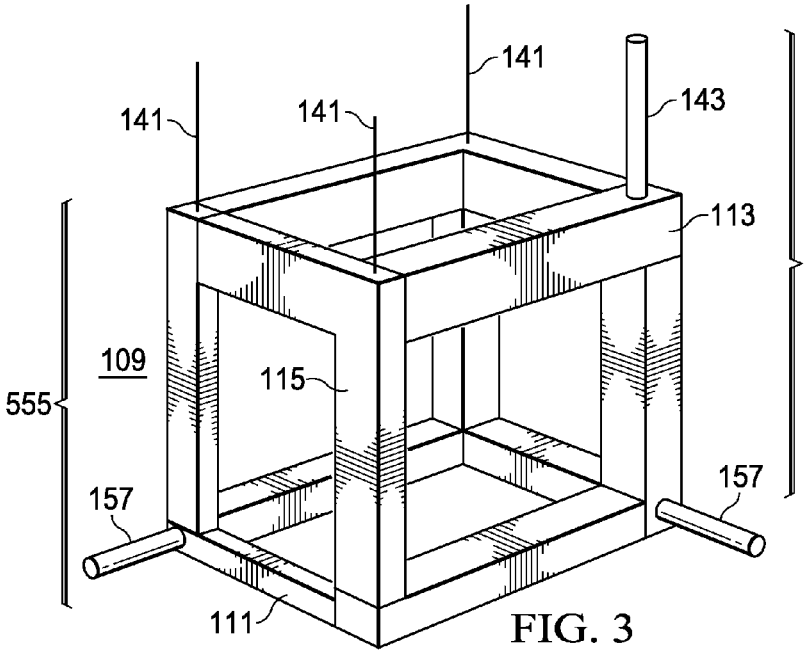
FIG. 3 illustrates a perspective view of the frame of the trash container of the present invention, according to an example embodiment.

FIG. 3 illustrates the frame 109 which may be formed from a bottom periphery member 111, a top periphery member 113 and a vertical member 115 which may be rectangular in cross-section. The first flexible wall 101, the back flexible wall 103, the pair of side flexible walls 105 and the bottom wall 107 (not shown) may be connected to a frame 109.

Figure 4:
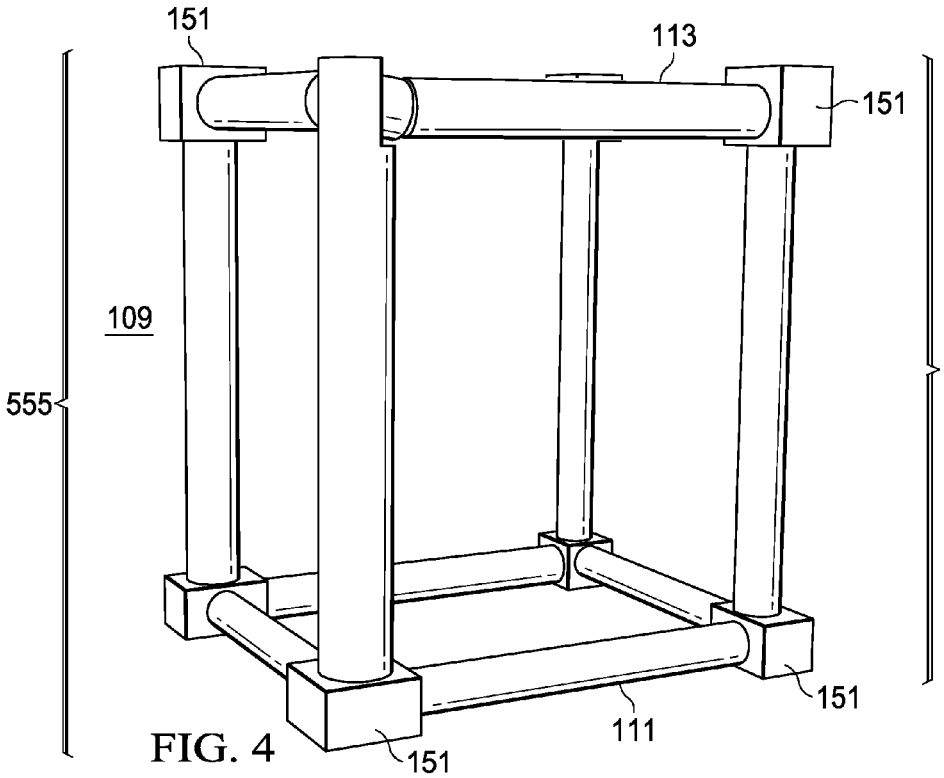
FIG. 4 illustrates a perspective view of the frame of the trash container of the present invention, according to an example embodiment.

FIG. 4 illustrates the frame 109 which may include the bottom periphery member 111, the top periphery member 113 and the vertical member 115 which may be cylinders and which may be connected by a rectangular member 151.

Figure 5:
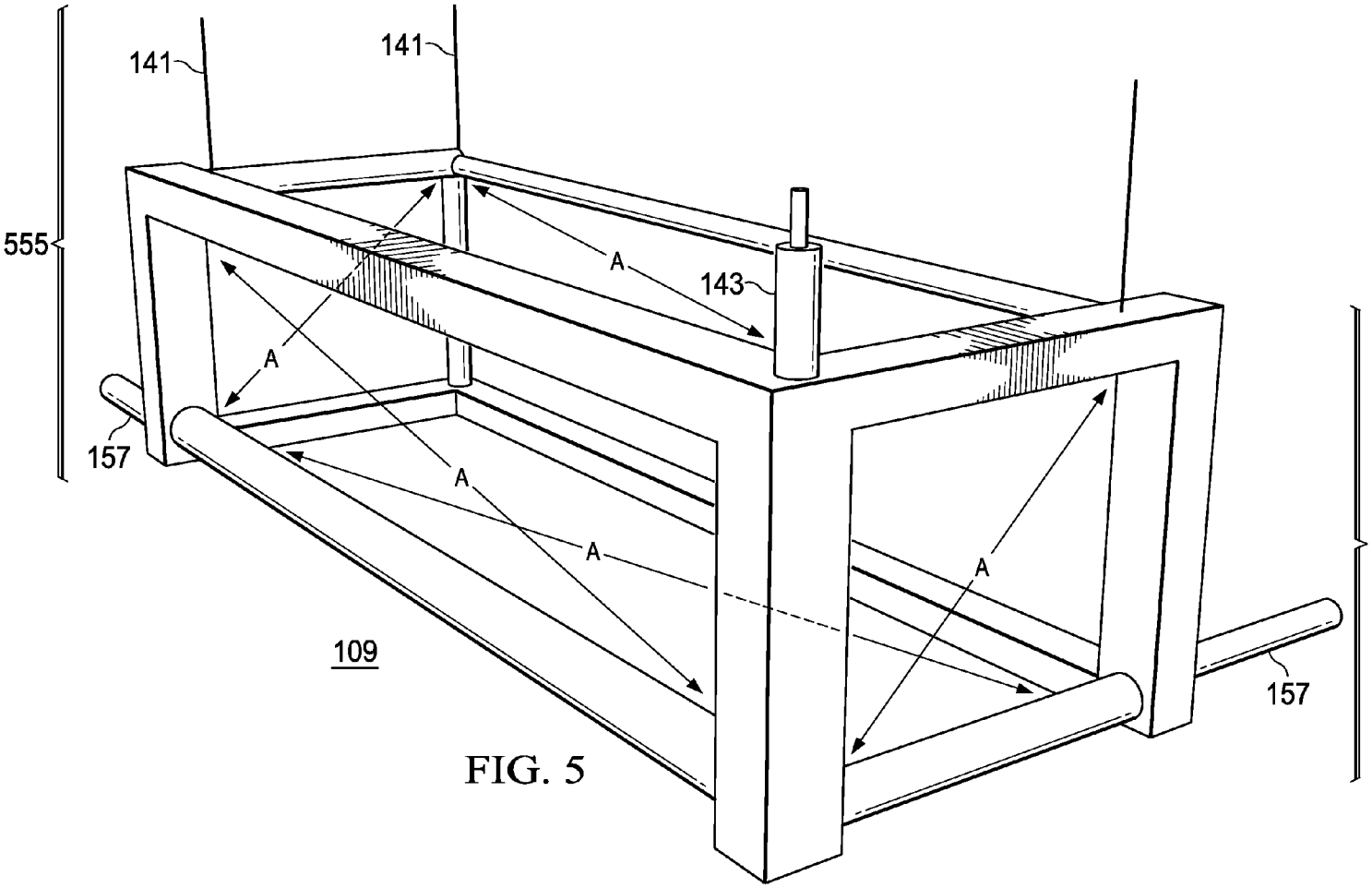
FIG. 5 illustrates a perspective view of the frame of the trash container of the present invention, according to an example embodiment.

FIG. 5 illustrates the frame 109 which may include the bottom periphery member 111 which may include cylinder and rectangular portions, the top periphery member 113 which may include cylinder and rectangular (where any other shape) portions and the vertical member 115 which may include cylinder and rectangular portions. The frame 109 may include a multitude of release valves 157.

Figure 6:
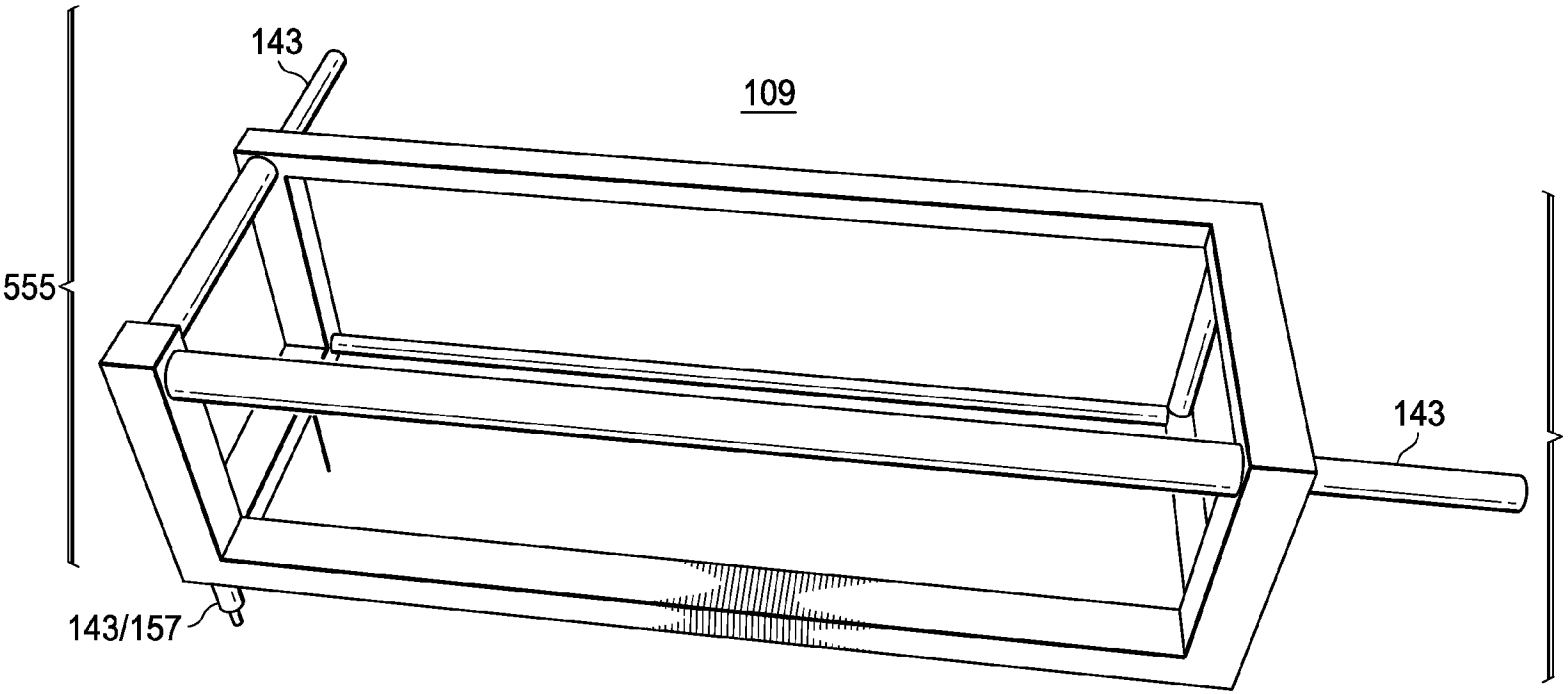
FIG. 6 illustrates a perspective view of the frame of the trash container of the present invention, according to an example embodiment.

FIG. 6 illustrates the frame 109 of FIG. 5 from a different angle.

The first flexible wall 101, the back flexible wall 103, the pair of side flexible walls 105 and the bottom wall 107 (not shown) may be connected to a frame 109. FIG. 6 illustrates different shapes combinations.

Figure 7:
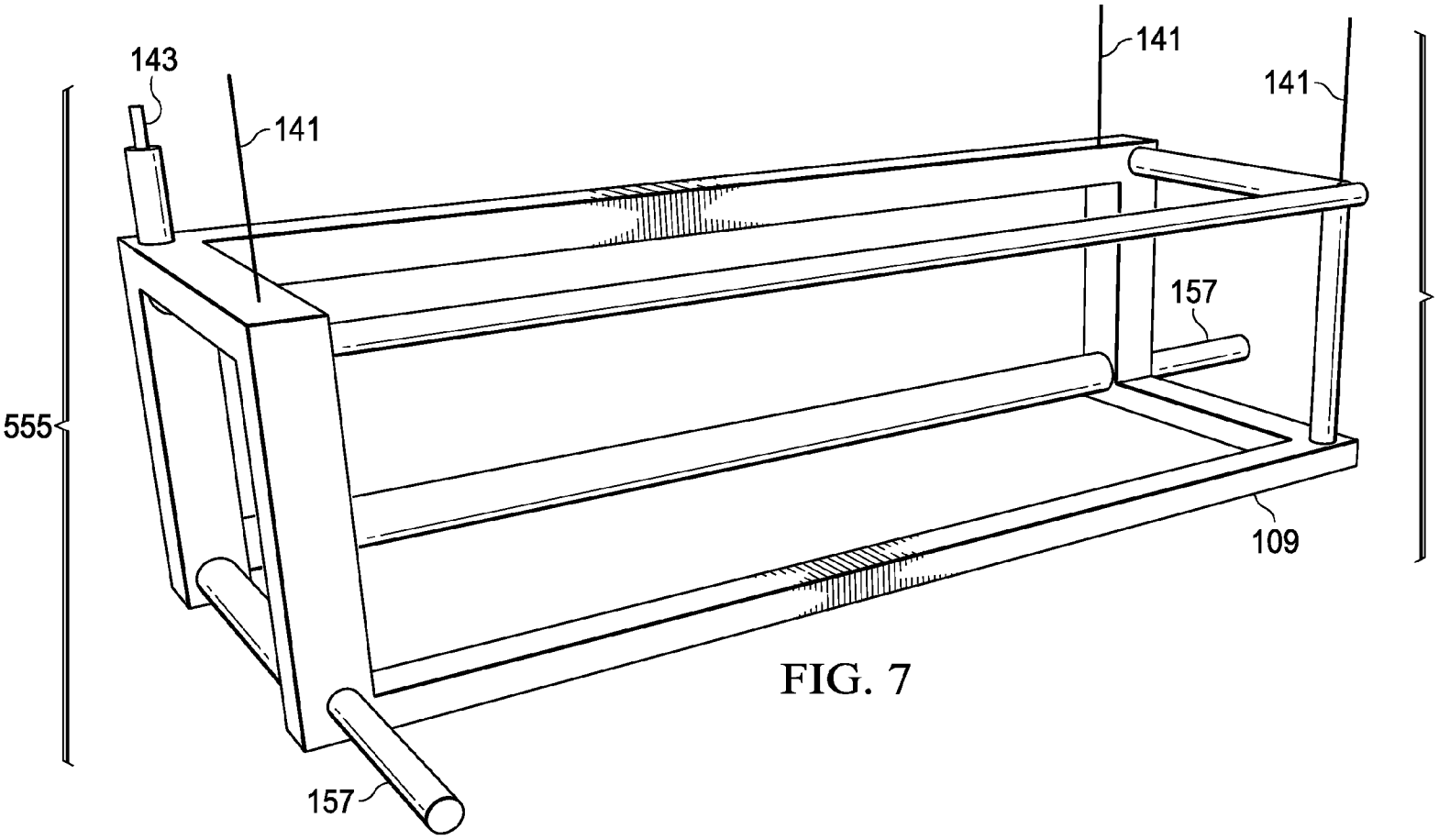
FIG. 7 illustrates a perspective view of the frame of the trash container of the present invention, according to an example embodiment.

FIG. 7 illustrates the frame 109 of FIG. 5 from a different angle.

The first flexible wall 101, the back flexible wall 103, the pair of side flexible walls 105 and the bottom wall 107 (not shown) may be connected to a frame 109. The present invention may include multiple inflator/deflator devices 143 for blowup and deflation. The frame 109 may be any appropriate size or shape. Element 157 is a quick deflator.

Figure 8:
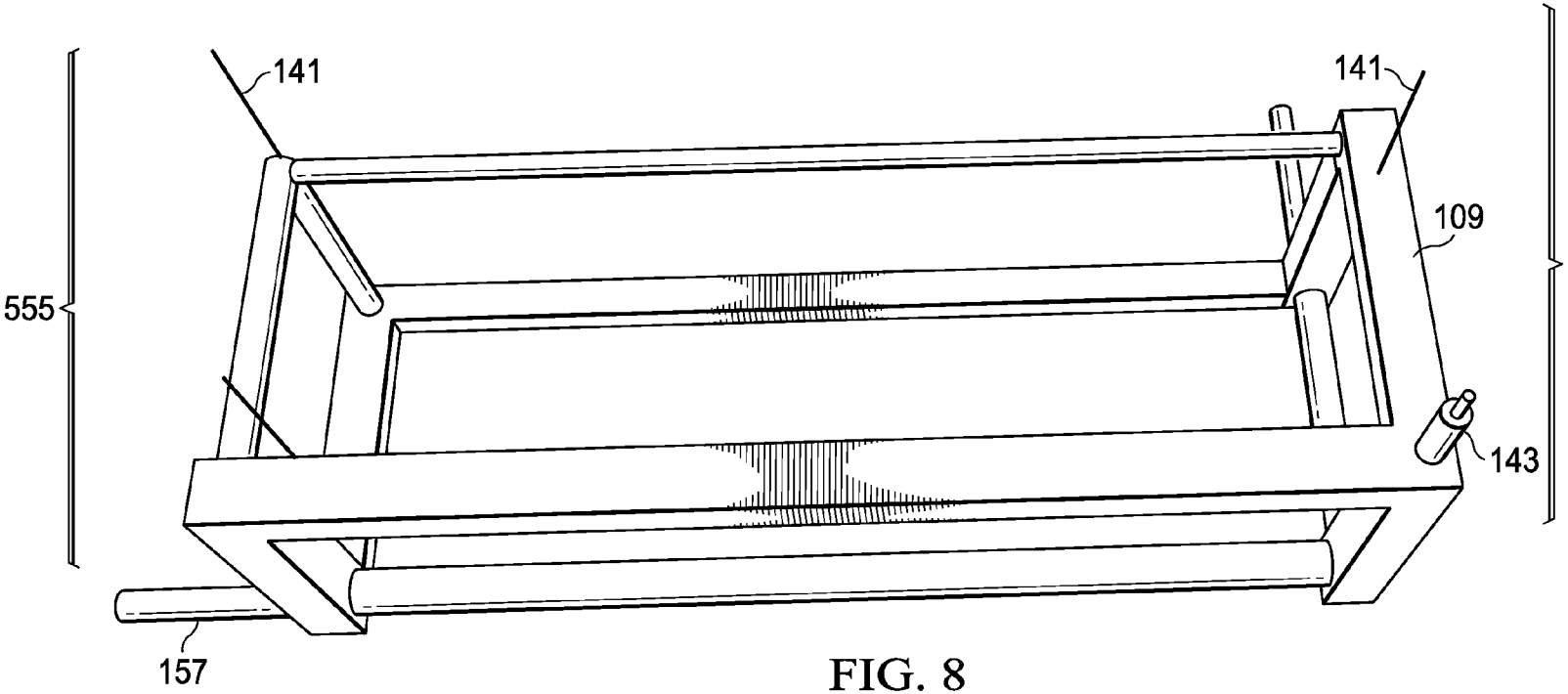
FIG. 8 illustrates a perspective view of the frame of the trash container of the present invention, according to an example embodiment.

FIG. 8 illustrates the frame 109 of FIG. 5 from a different angle. The frame 109 may be any appropriate size or shape.

The first flexible wall 101, the back flexible wall 103, the pair of side flexible walls 105 and the bottom wall 107 (not shown) may be connected to a frame 109.

Figure 9:
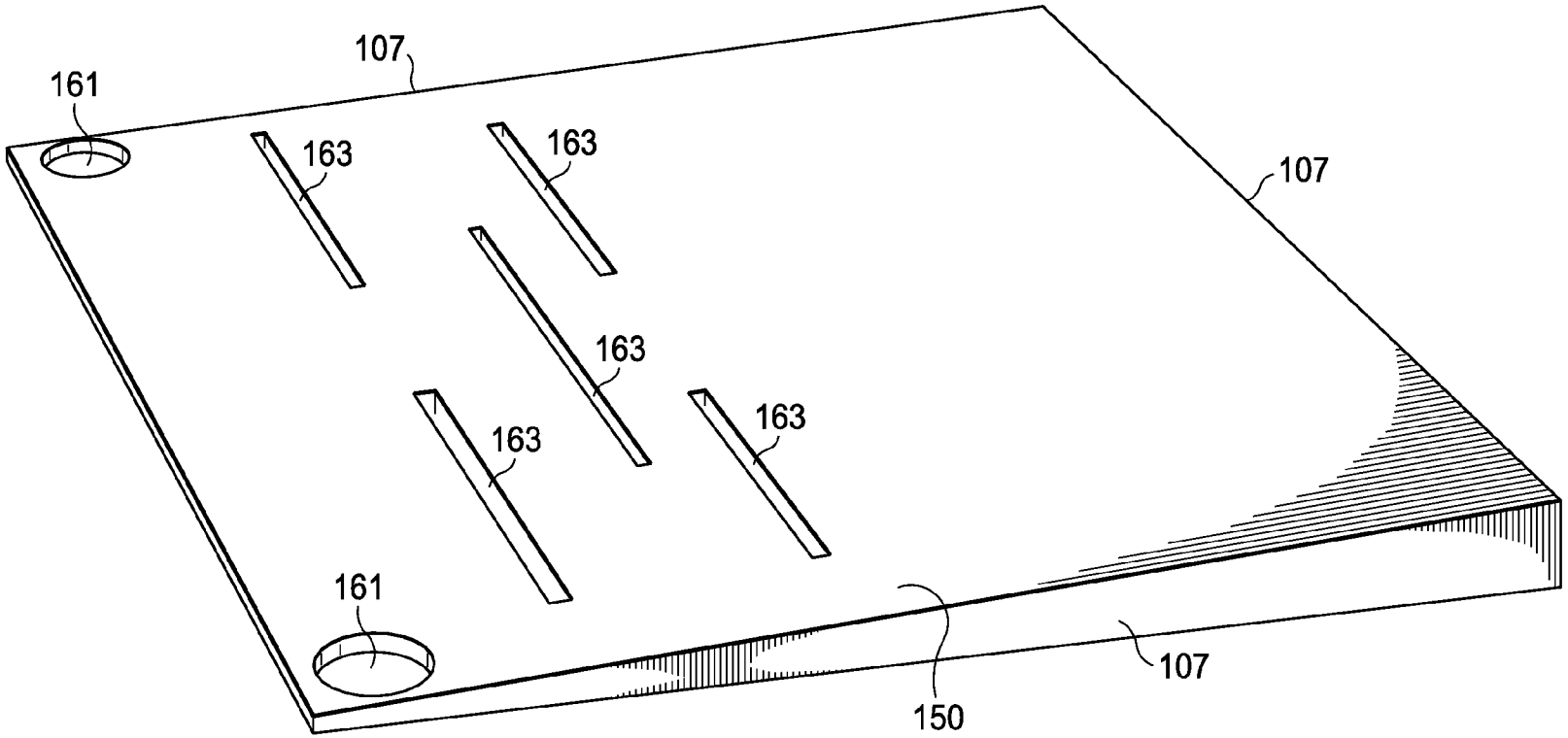
FIG. 9 illustrates a perspective view of the bottom wall of the trash container of the present invention, according to an example embodiment.

FIG. 9 illustrates the bottom wall 107 of the frame 109 which may be substantially flat or may be inclined (as illustrated) to allow any liquids which has been placed into the trash container 101 to flow to the lowest level of the bottom wall 107 and out of the trash container. The bottom wall 107 may include a multitude of slits 163 and may include an aperture 161 which may cooperate with the vertical member 115. FIG. 9 additionally illustrates a mat 150 which may be absorbing or non-absorbing to prevent liquids from escaping from the frame 109 on to the support surface.

Figure 10:
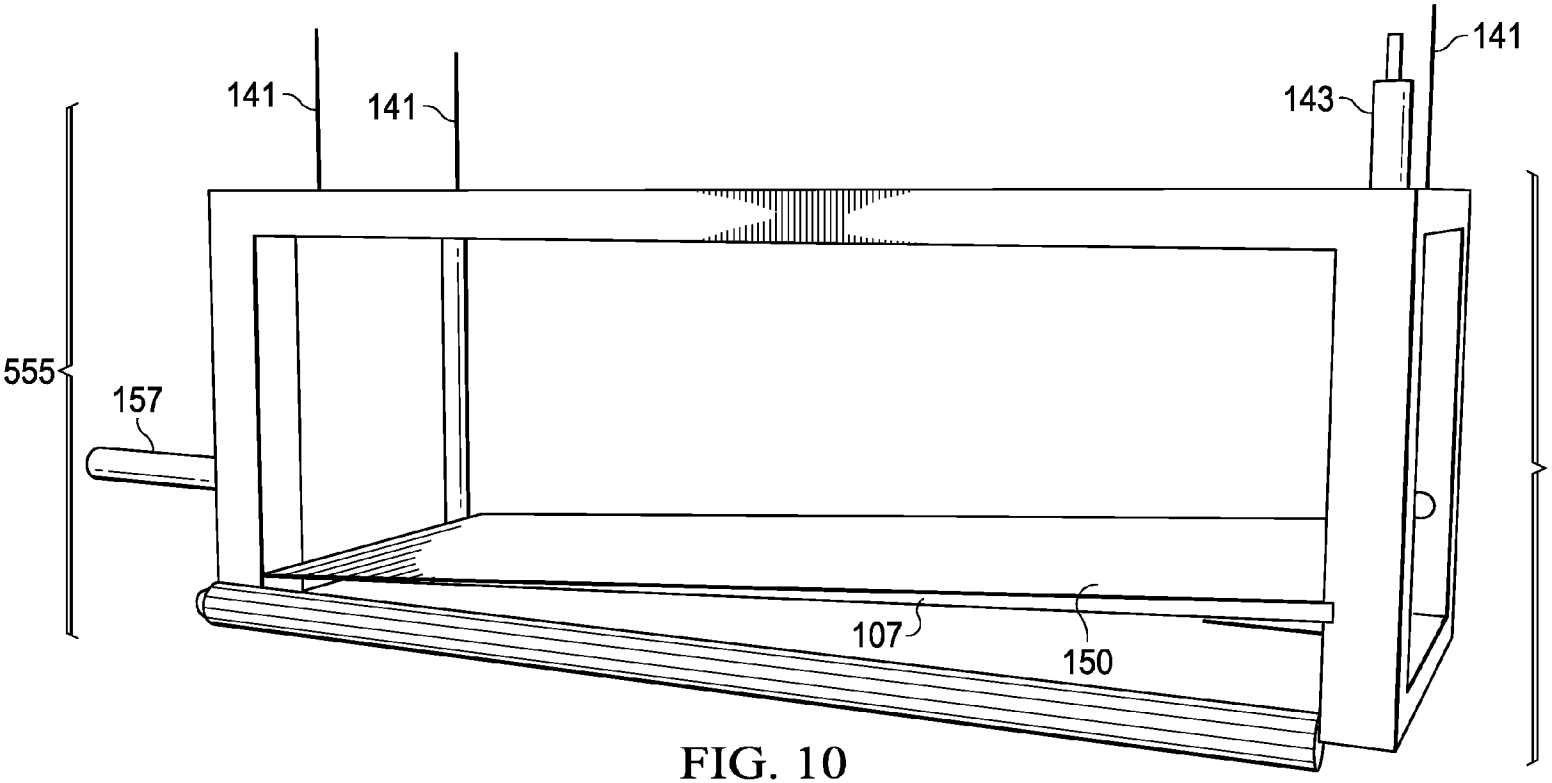
FIG. 10 illustrates a perspective view of the frame of the trash container of the present invention, according to an example embodiment.

FIG. 10 illustrates a perspective view of the frame 109 which may include an inclined bottom wall 107, a multitude of tie down straps 141, an inflator/deflator device 143 and a release valve 157. FIG. 10 additionally illustrates a mat 150 which may be absorbing or non-absorbing to prevent liquids from escaping from the frame 109 on to the support surface. The mat 150 may be positioned between the bottom wall 107 and the bottom layer. The tied down straps may be used to gather the container together in order to conveniently dispose of the contents of the container.

Figure 11:
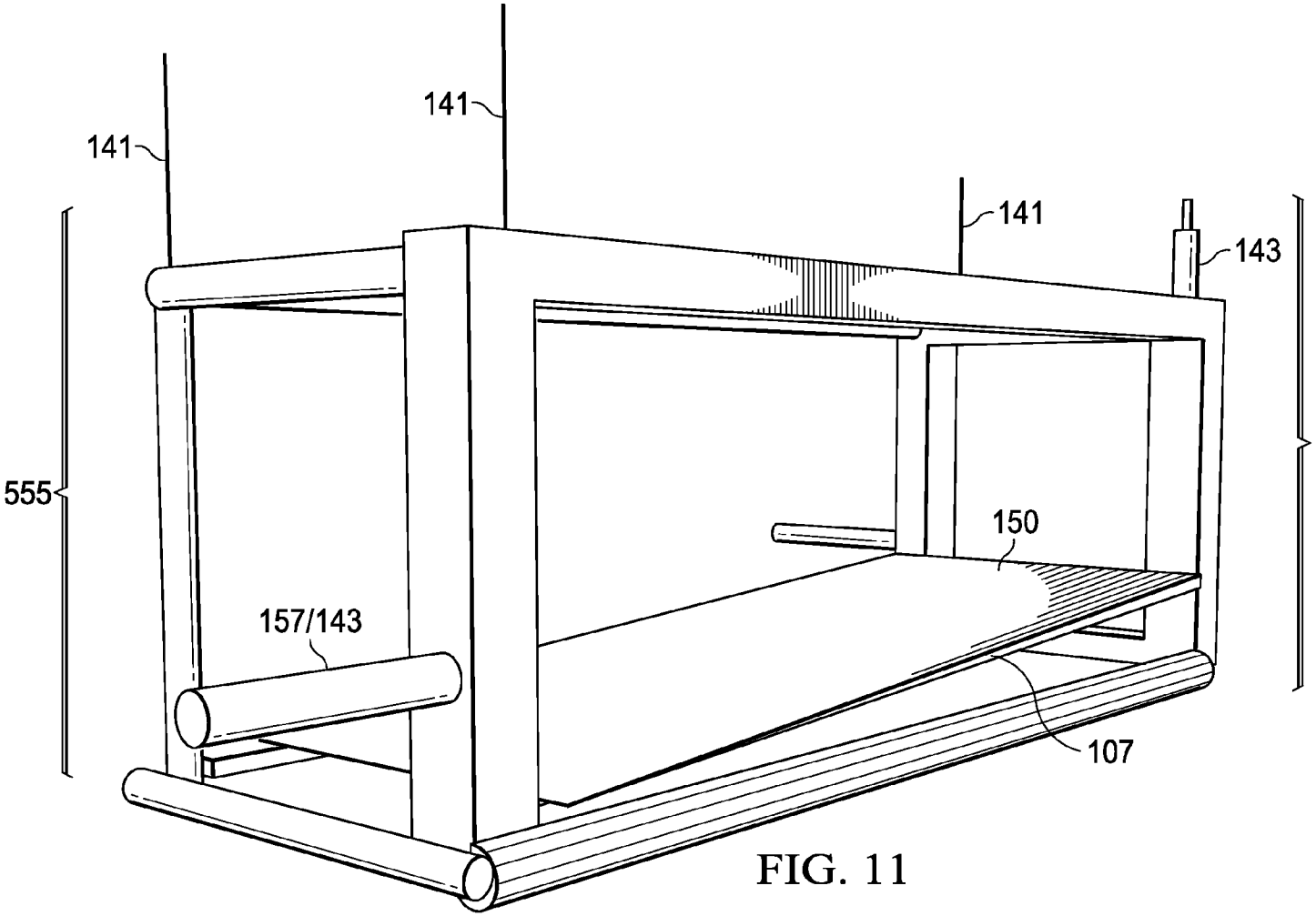
FIG. 11 illustrates a perspective view of the frame of the trash container of the present invention, according to an example embodiment.

FIG. 11 illustrates a perspective view of the frame 109 which may include an inclined bottom wall 107, a multitude of tied down straps 141, an inflator/deflator device 143 and a release valve 157.

Figure 11A:
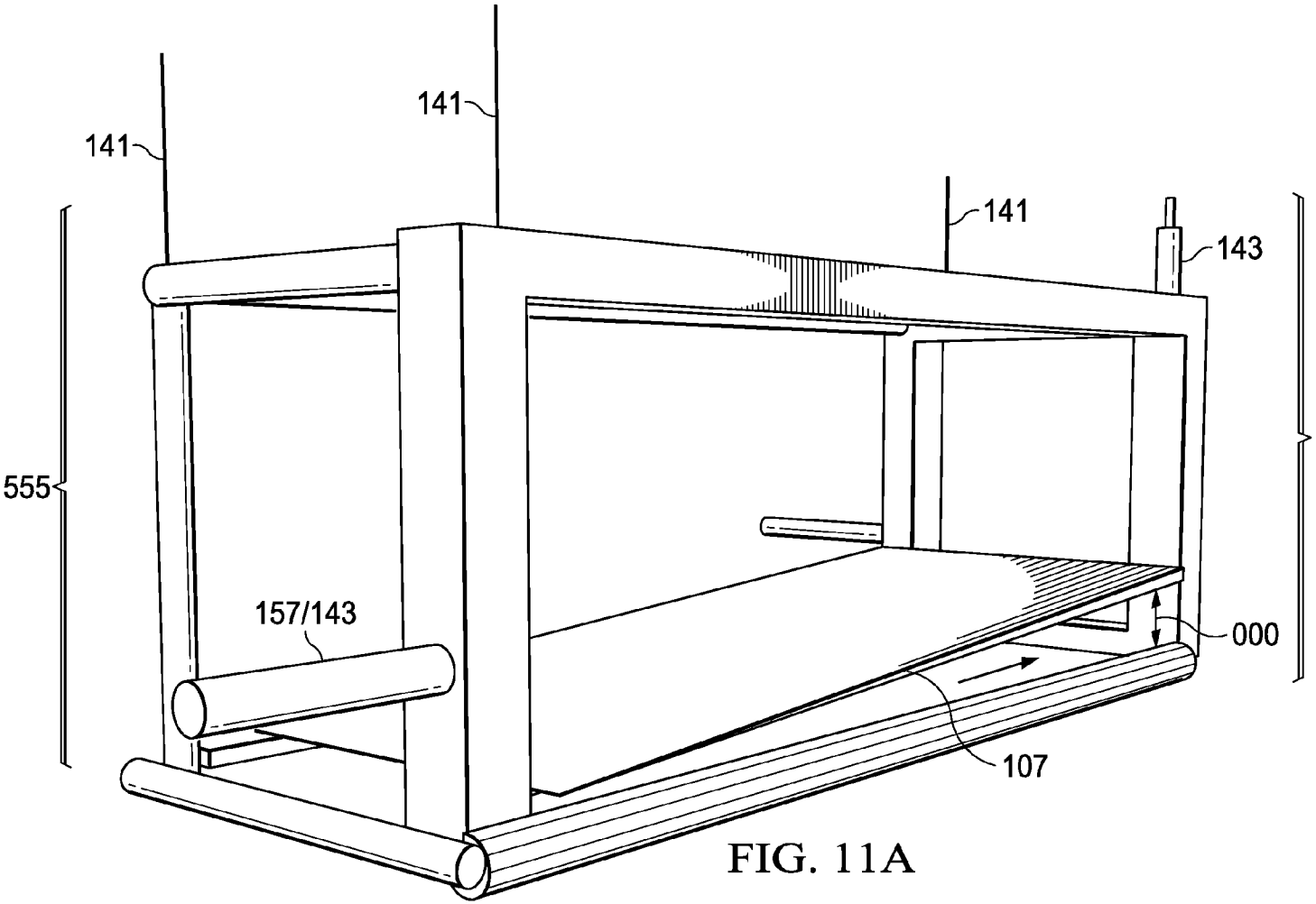
FIG. 11A illustrates a perspective view of the frame of the trash container of the present invention, according to an example embodiment.

FIG. 11A illustrates an absorption system which may be positioned within the cavity 000 and which may be positioned under the rigid or non-rigid bottom wall 107.

Figure 12:
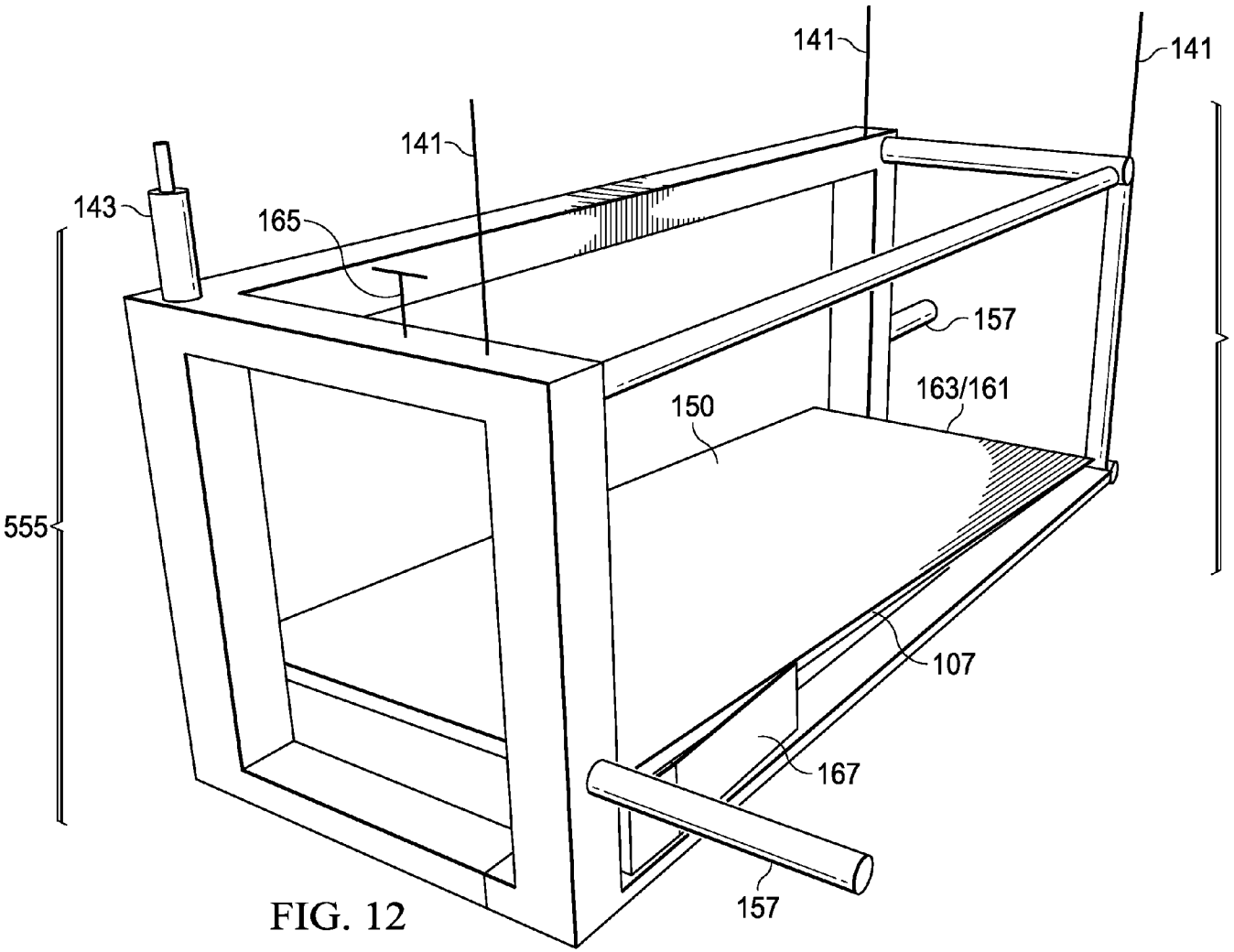
FIG. 12 illustrates a perspective view of the frame of the trash container of the present invention, according to an example embodiment.

FIG. 12 illustrates a perspective view of the frame 109 which may include an inclined bottom wall 107, a multitude of tied down straps 141, an inflator/deflator device 143 and a multitude of release valves 157. Additionally, FIG. 12 illustrates a support member 167 which may be a rectangle to support the bottom wall 107 and support the inclined aspect of the inclined bottom wall 107. FIG. 12 illustrates a cleat 165 to attach to a dog leash. The support member 167 may be inflatable in order to support a pet. FIG. 12 additionally illustrates a mat 150 which may be absorbing or non-absorbing to prevent liquids and or solid waste material from escaping from the frame 109 on to the support surface. FIG. 12 illustrates a support system 167 which may be mounted under the bottom wall 107 and may be positioned within the cavity 000.

Figure 13:
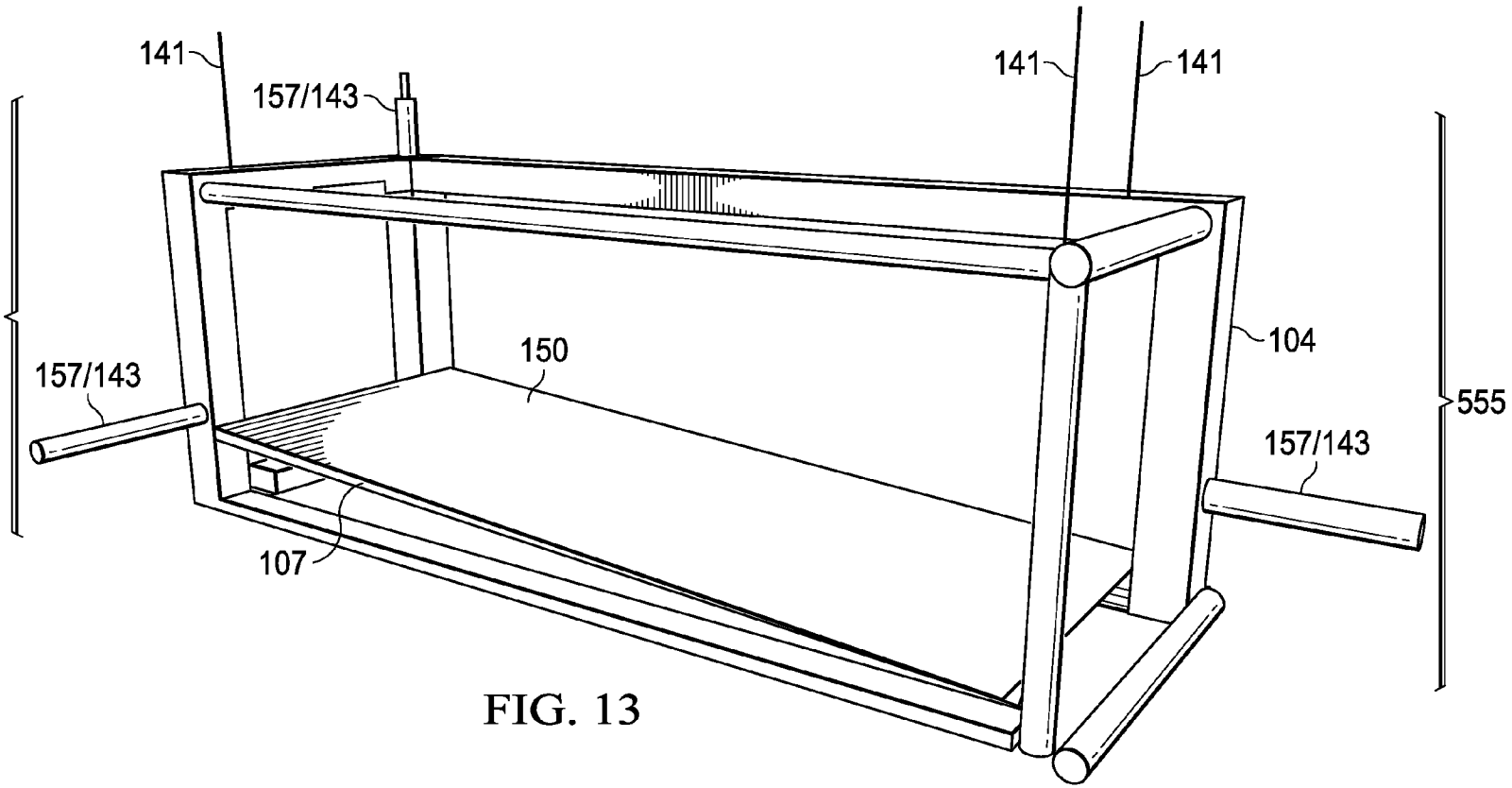
FIG. 13 illustrates a perspective view of the frame of the trash container of the present invention, according to an example embodiment.

FIG. 13 illustrates a perspective view of the frame 109 which may include an inclined bottom wall 107, a multitude of tied down straps 141, an inflator/deflator device 143 and a release valve 157.

Figure 14:
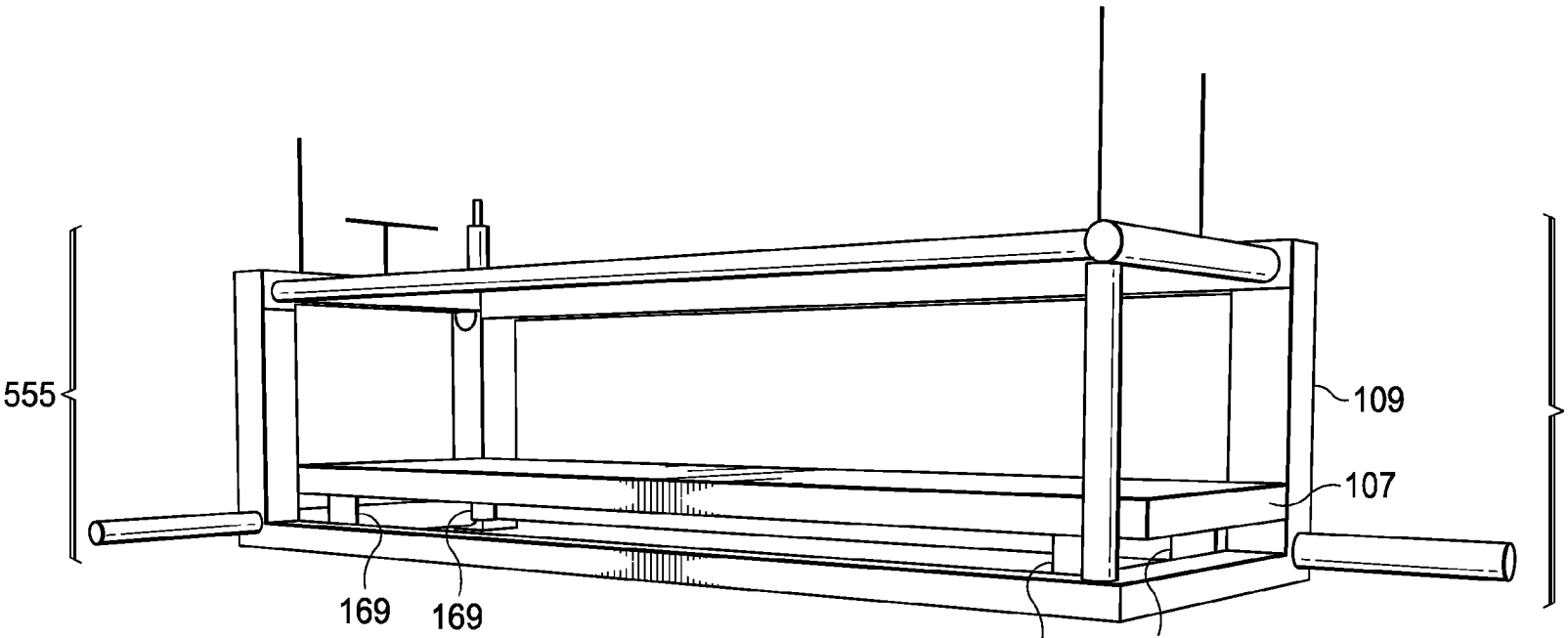
FIG. 14 illustrates a perspective view of the frame of the trash container of the present invention, according to an example embodiment.

FIG. 14 illustrates a perspective view of the frame 109 which may include a bottom wall 107 which may be supported by a multitude of floor supports 169 (inflatable support surface), a multitude of tied down straps 141, an inflator/deflator device 143 and a multitude of release valves 157. FIG. 14 illustrates a cleat 165 to attach to a dog leash.

Figure 15:
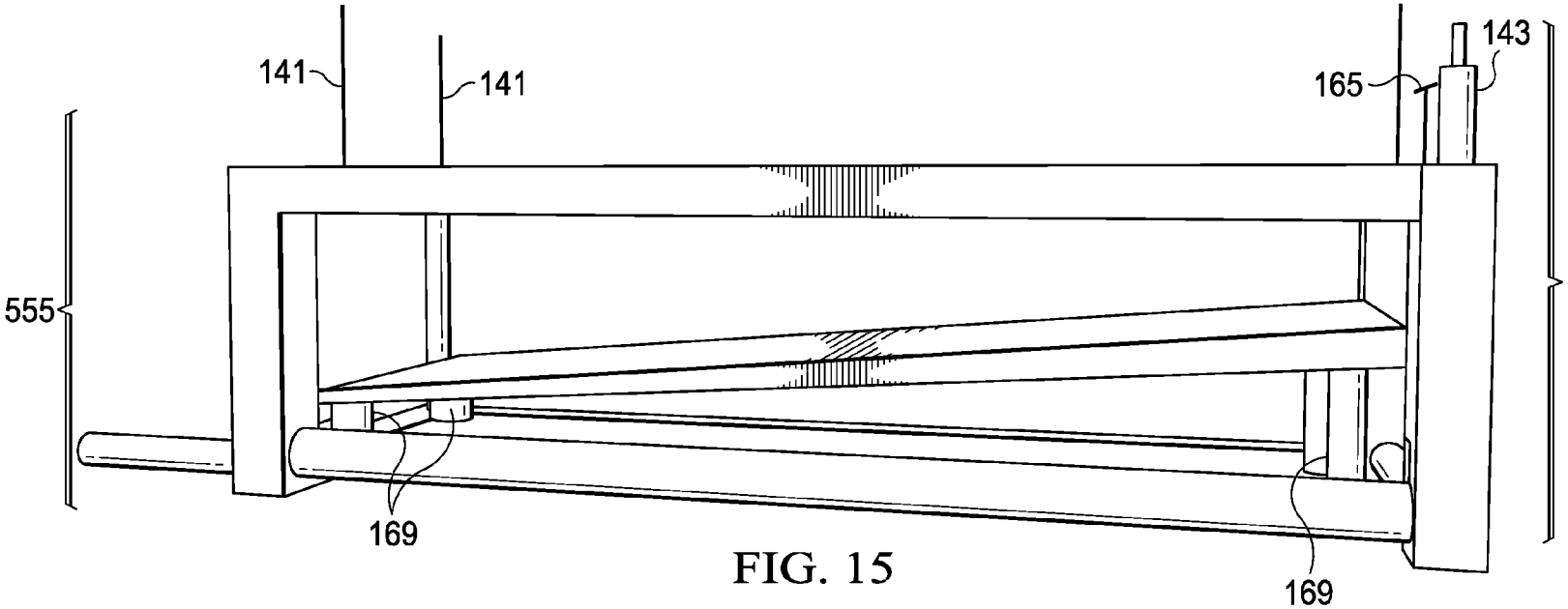
FIG. 15 illustrates a perspective view of the frame of the trash container of the present invention, according to an example embodiment.

FIG. 15 illustrates a perspective view of the frame 109 which may include an inclined bottom wall 107 which may be supported by a multitude of floor supports 169 (inflatable support surface), a multitude of tied down straps 141, an inflator/deflator device 143 and a release valve 157.

Figure 16:
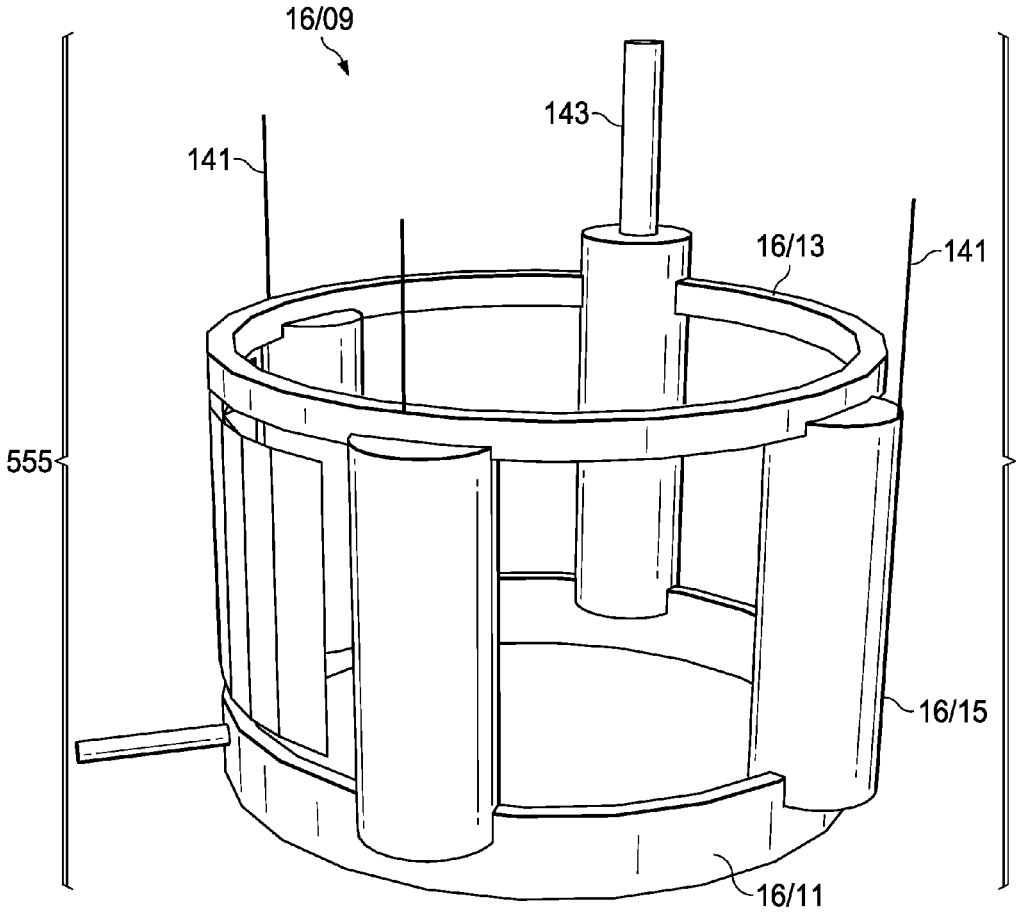
FIG. 16 illustrates a perspective view of another embodiment of the frame of the trash container of the present invention, according to an example embodiment.

FIG. 16 shows the bottom periphery member 16/11 which may be formed in a substantial ring, the top periphery member 16/13 which may be formed in a substantial ring and the vertical member 16/15 being a cylinder having a circular cross-section.

FIG. 16 additionally illustrates tied down straps 141 to be used to tie down the trash container 100, and FIG. 16 illustrates an inflation/deflation device 143 to allow the frame 16/09 to be inflated or deflated which may include an adjustable valve to seal and unseal the frame 109.

Figure 17:
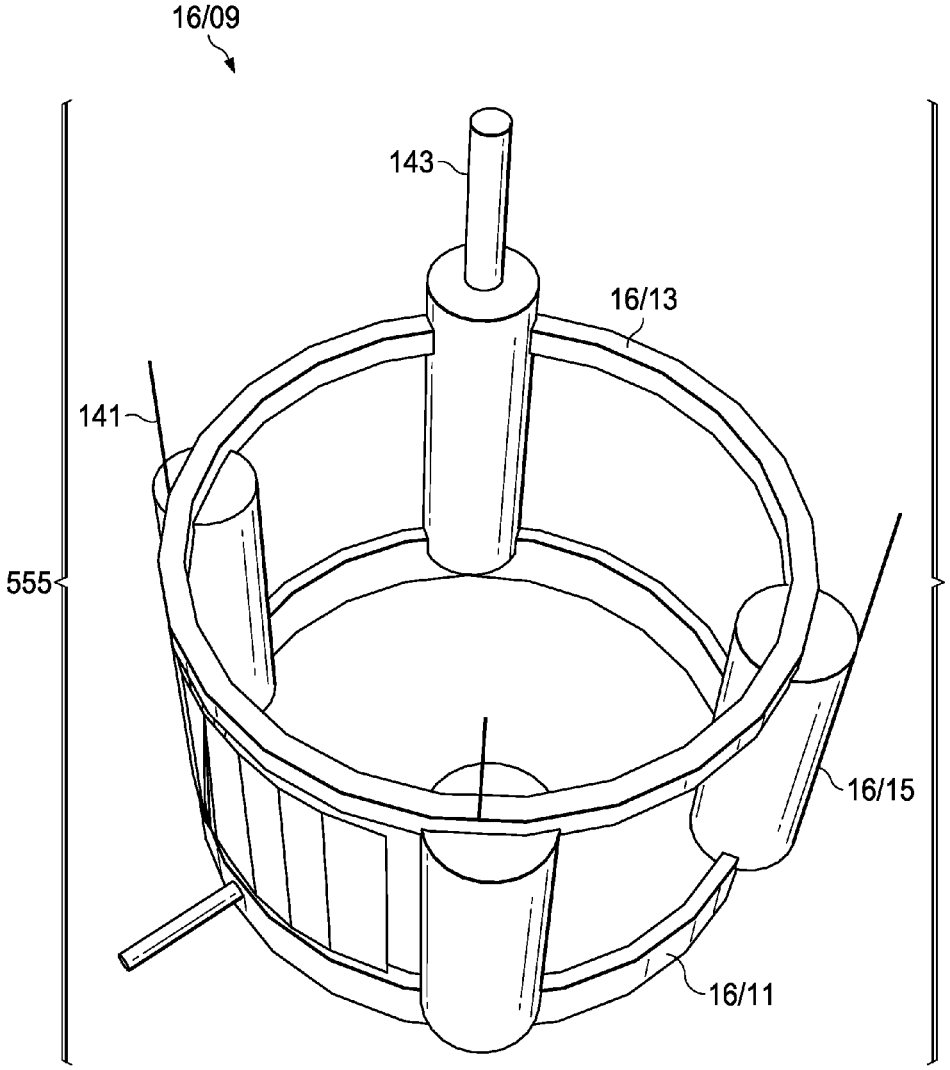
FIG. 17 illustrates a perspective view of another embodiment of the frame of the trash container of the present invention, according to an example embodiment.

FIG. 17 shows the bottom periphery member 16/11 which may be formed in a substantial ring, the top periphery member 16/13 which may be formed in a substantial ring and the vertical member 16/15 being a cylinder having a circular cross-section.

Figure 18:
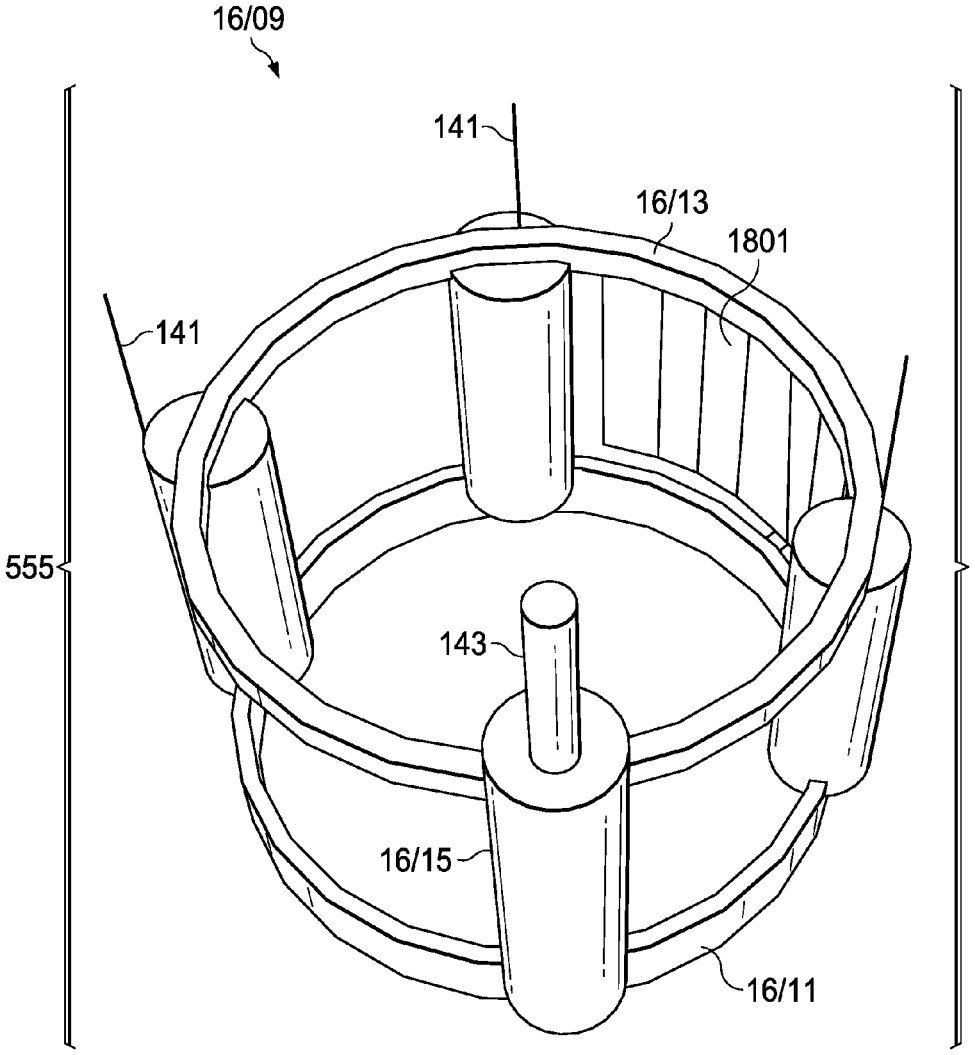
FIG. 18 illustrates a perspective view of another embodiment of the frame of the trash container of the present invention, according to an example embodiment.

FIG. 17 additionally illustrates tied down straps 141 to be used to tie down the trash container 100, and FIG. 18 illustrates an inflation/deflation device 143 to allow the frame 16/09 to be inflated or deflated which may include an adjustable valve to seal and unseal the frame 109.

FIG. 18 shows the bottom periphery member 16/11 which may be formed in a substantial ring, the top periphery member 16/13 which may be formed in a substantial ring and the vertical member 16/15 being a cylinder having a circular cross-section.

FIG. 18 additionally illustrates tied down straps 141 to be used to tie down the trash container 100, and FIG. 18 illustrates an inflation/deflation device 143 to allow the frame 16/09 to be inflated or deflated which may include an adjustable valve to seal and unseal the frame 109.

FIG. 18 illustrates a portion of the sidewall 1801 which may extend around the periphery of the frame 16/09.

Figure 19:
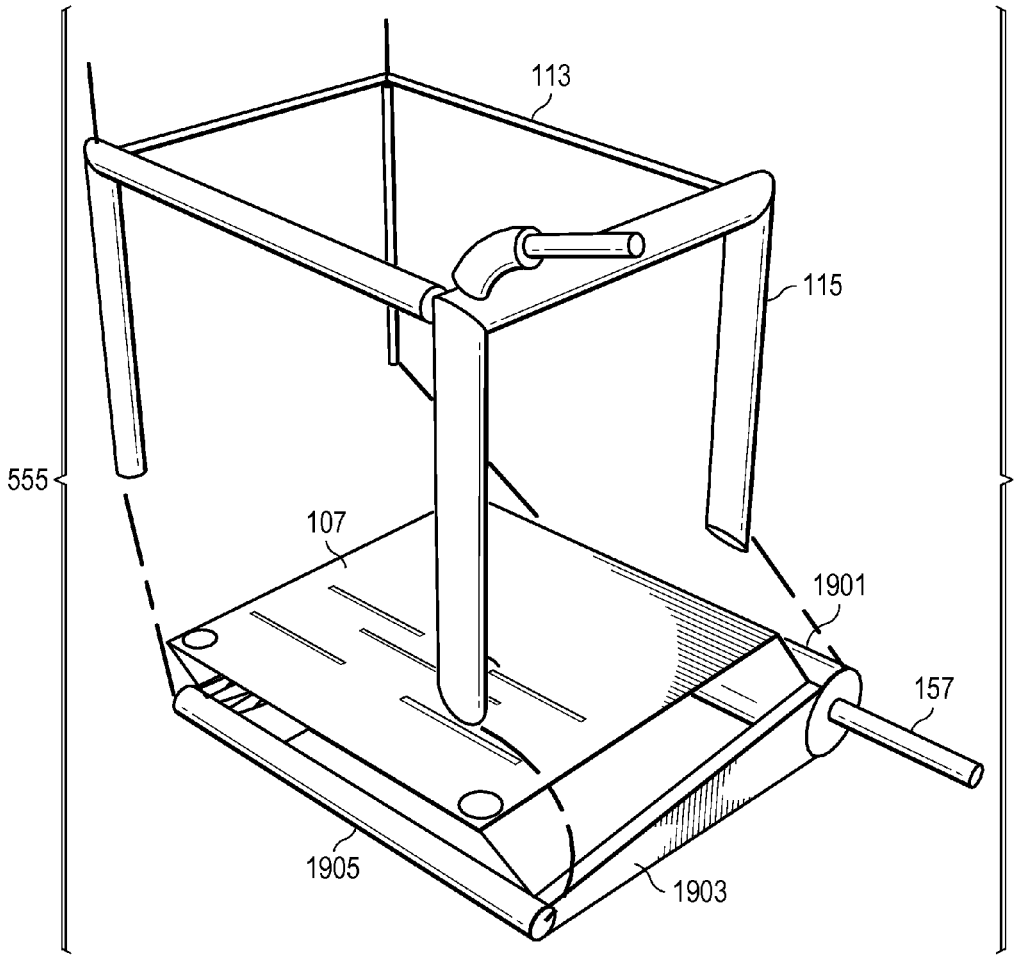
FIG. 19 illustrates an exploded view of the frame of the trash container of the present invention, according to an example embodiment.

FIG. 19 illustrates a base member 1901 which may include a back cylinder support 1902 a pair of opposing side walls 1903 which may be inclined and extend from the back cylinder support 1902 to the front wall 1905. The end of the base member 1901 may include a release valve 157, and the base member 1901 may support the bottom wall 107 as illustrated in FIG. 9. The base member 1901 may be connected to the vertical member 115 so that the base member 101, the vertical member 115 and the top periphery member 113 may be inflated/deflated simultaneously.

Figure 20:
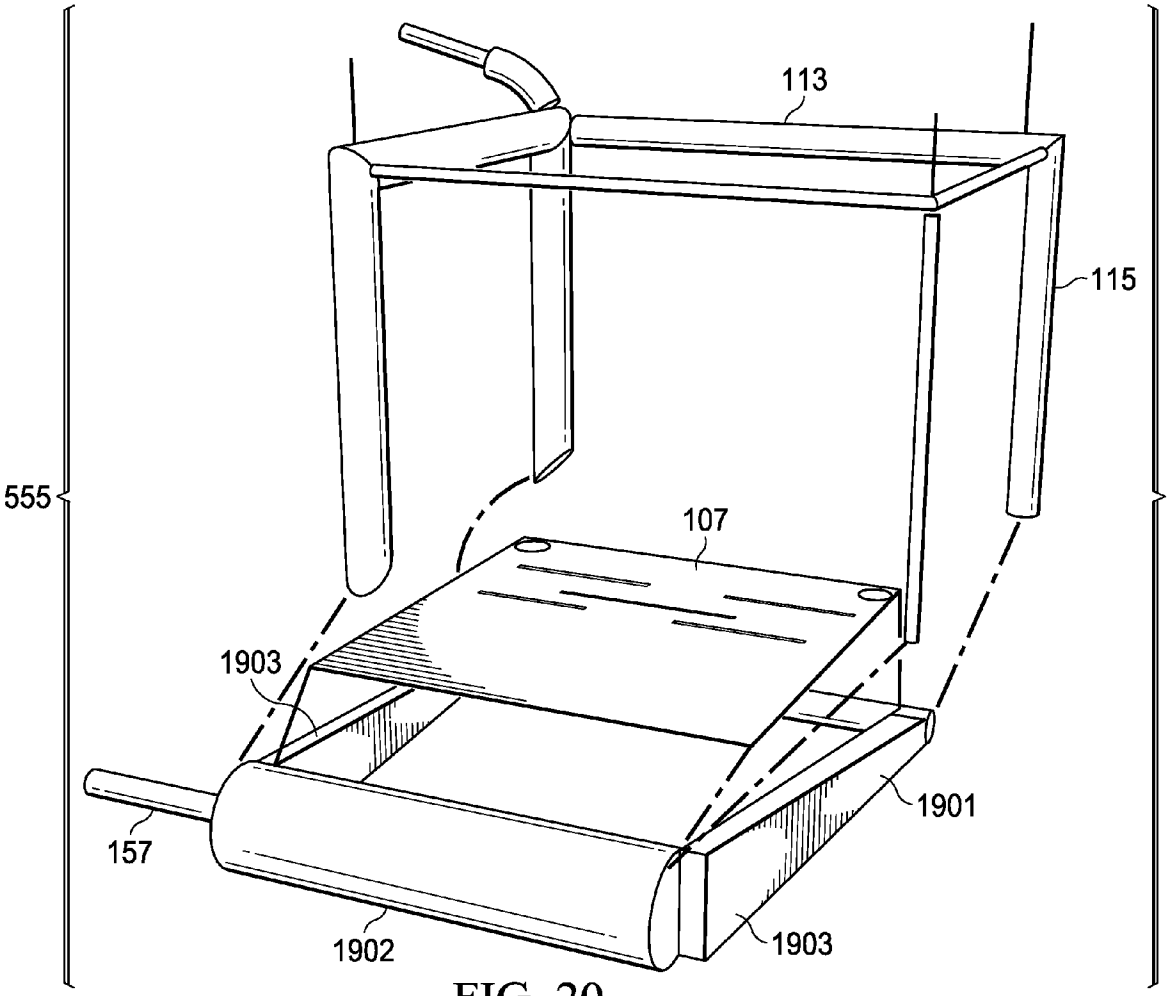
FIG. 20 illustrates an exploded view of the frame of the trash container of the present invention, according to an example embodiment.

FIG. 20 illustrates a base member 1901 which may include a back cylinder support 1902 a pair of opposing side walls 1903 which may be inclined and extend from the back cylinder support 1902 to the front wall 1905 (not shown). The end of the base member 1901 may include a release valve 157, and the base member 1901 may support the bottom wall 107 as illustrated in FIG. 9. The base member 1901 may be connected to the vertical member 115 so that the base member 101, the vertical member 115 and the top periphery member 113 may be inflated/deflated simultaneously.

Figure 21:
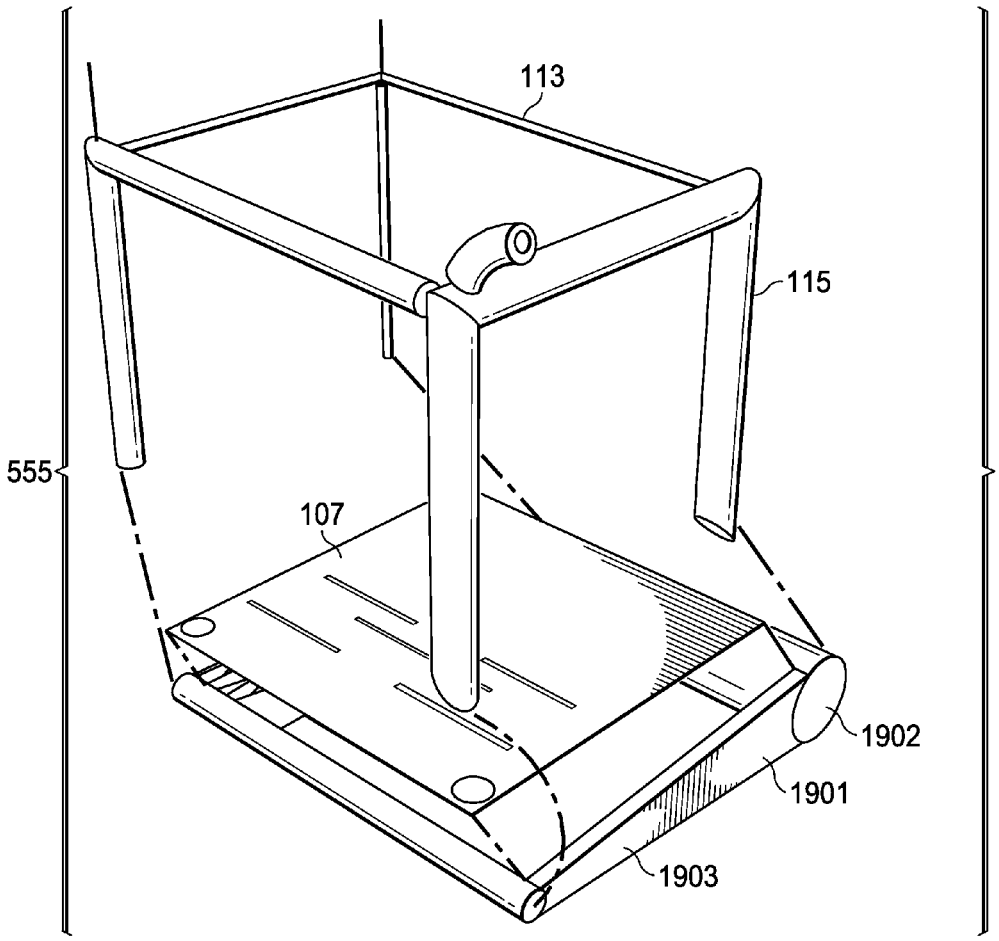
FIG. 21 illustrates an exploded view of the frame of the trash container of the present invention, according to an example embodiment.

FIG. 21 illustrates a base member 1901 which may include a back cylinder support 1902, a pair of opposing side walls 1903 which may be inclined and extend from the back cylinder support 1902 to the front wall 1905. The end of the base member 1901 may include a release valve 157, and the base member 1901 may support the bottom wall 107 as illustrated in FIG. 9. The base member 1901 may be connected to the vertical member 115 so that the base member 101, the vertical member 115 and the top periphery member 113 may be inflated/deflated simultaneously.

Figure 22:
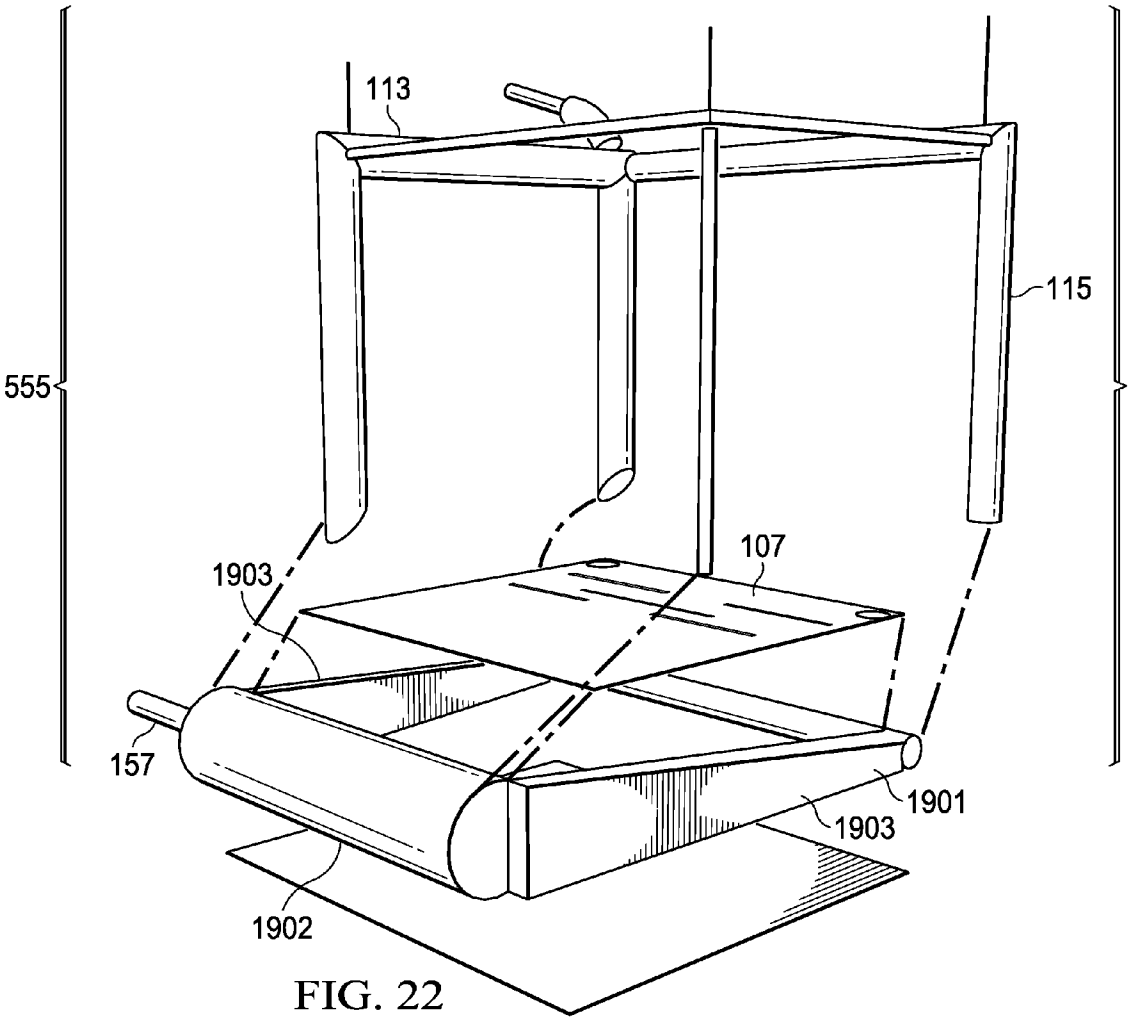
FIG. 22 illustrates an exploded view of the frame of the trash container of the present invention, according to an example embodiment.

FIG. 22 illustrates a base member 1901 which may include a back cylinder support 1902 or any other shape, a pair of opposing side walls 1903 which may be inclined and extend from the back cylinder support 1902 to the front wall 1905. The end of the base member 1901 may include a release valve 157, and the base member 1902, may support the bottom wall 107 as illustrated in FIG. 9. The base member 1901 may be connected to the vertical member 115 so that the base member 101, the vertical member 115 and the top periphery member 113 may be inflated/deflated simultaneously.

Figure 23:
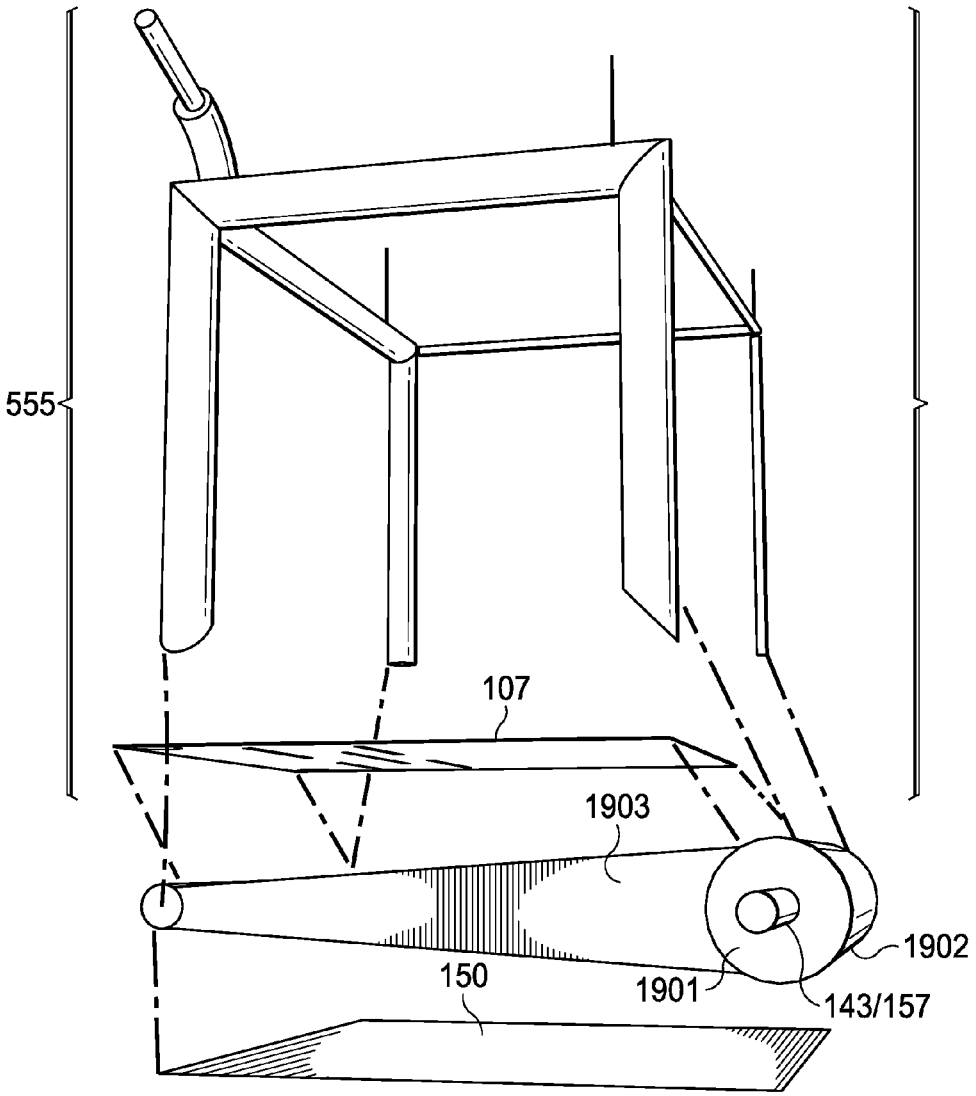
FIG. 23 illustrates an exploded view of the frame of the trash container of the present invention, according to an example embodiment.

FIG. 23 illustrates a base member 1901 which may include a back cylinder support 1902, a pair of opposing side walls 1903 which may be inclined and extend from the back cylinder support 1902 to the front wall 1905. The end of the base member 1901 may include a release valve 157, and the base member 1901 may support the bottom wall 107 as illustrated in FIG. 9. The base member 1901 may be connected to the vertical member 115 so that the base member 101, the vertical member 115 and the top periphery member 113 may be inflated/deflated simultaneously.

Figure 24:
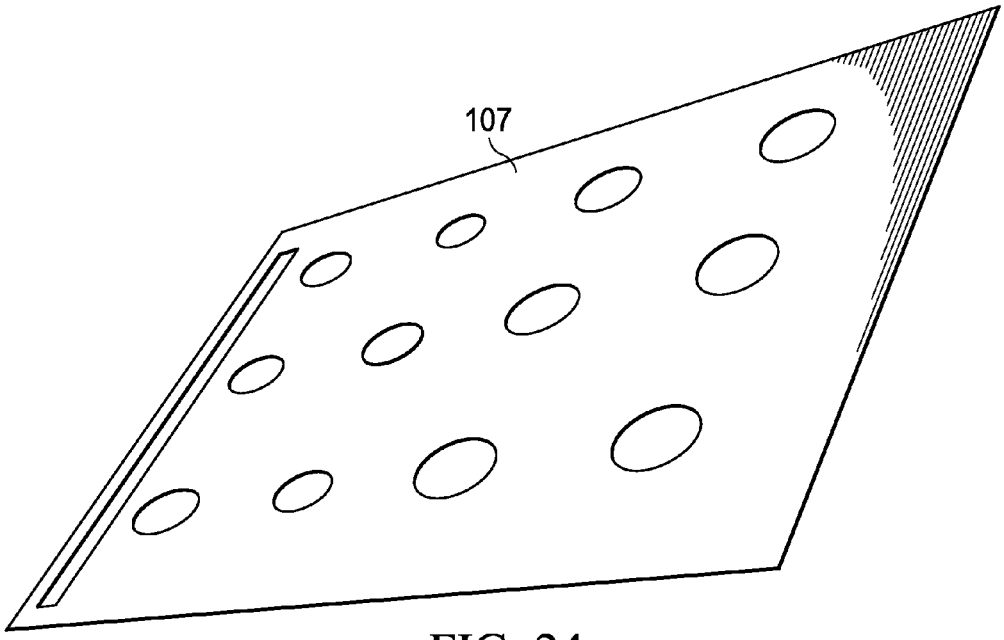
FIG. 24 illustrates a view of the bottom wall of the trash container of the present invention, according to an example embodiment.

FIG. 24 illustrates the bottom wall 107 having a multitude of apertures and a slot.

Figure 25:
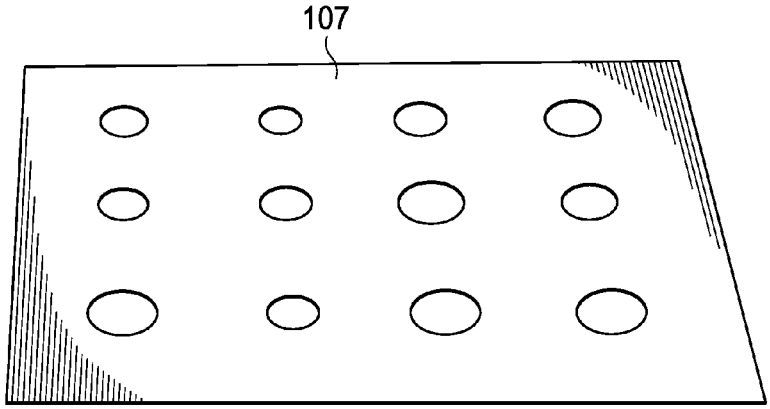
FIG. 25 illustrates a view of the bottom wall of the present invention, according to an example embodiment.

FIG. 25 illustrates the bottom wall 107 having a multitude of apertures.

Figure 26:
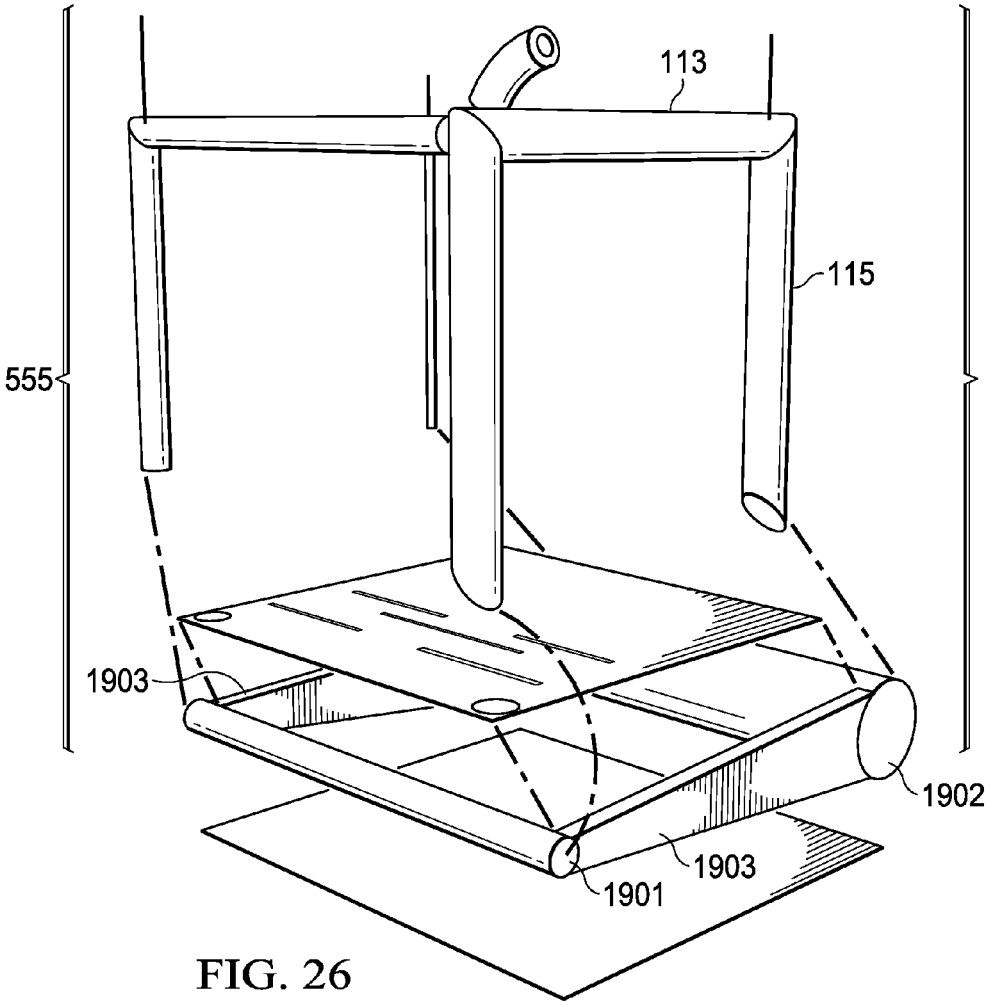
FIG. 26 illustrates an exploded view of the frame of the present invention, according to an example embodiment.

FIG. 26 illustrates a base member 1901 which may include a back cylinder support 1902, a pair of opposing side walls 1903 which may be inclined and extend from the back cylinder support 1902 to the front wall 1905. The end of the base member 1901 may include a release valve 157, and the base member 1901 may support the bottom wall 107 as illustrated in FIG. 9. The base member 1901 may be connected to the vertical member 115 so that the base member 101, the vertical member 115 and the top periphery member 113 may be inflated/deflated simultaneously.

Figure 27:
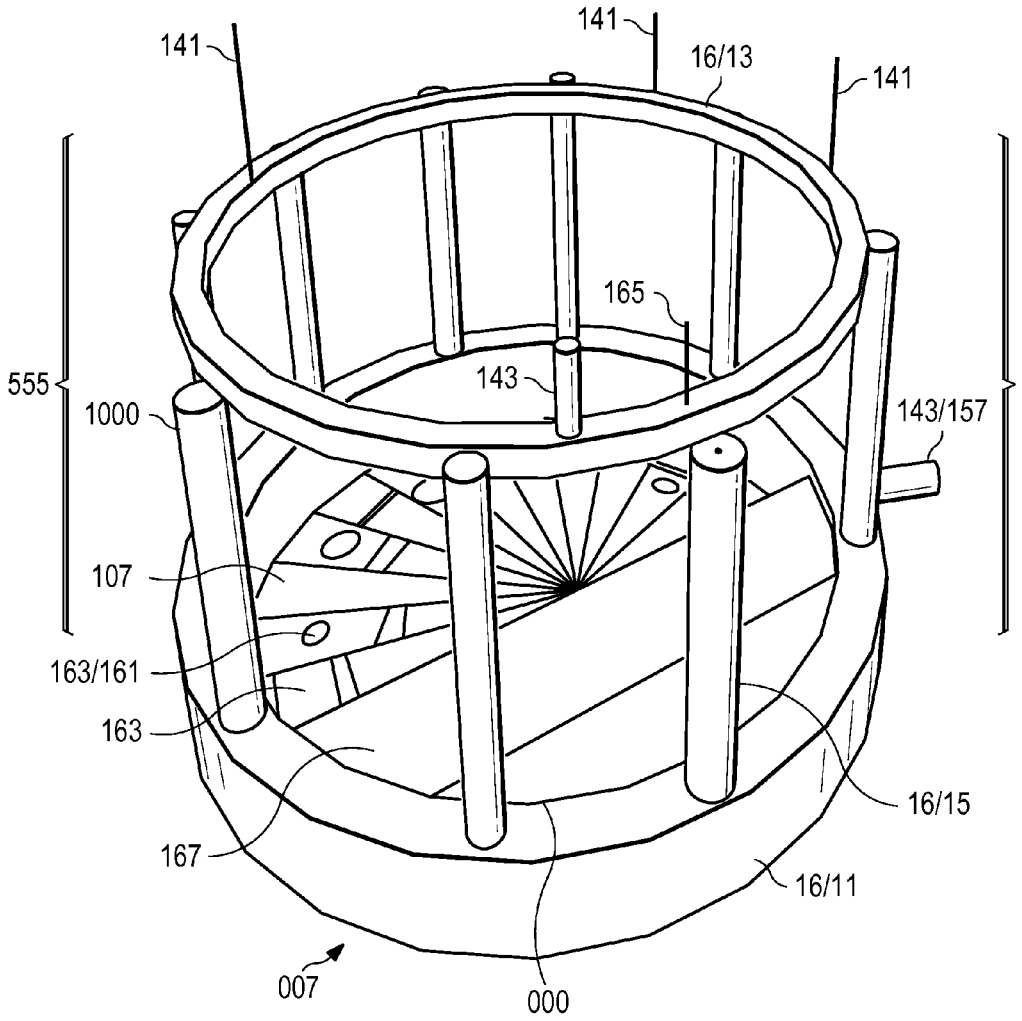
FIG. 27 illustrates an exploded view of the frame of the present invention, according to an example embodiment.

FIG. 27 shows the periphery member 16/11 which may be formed in a substantial ring of any geometric shape. The top periphery member 16/13 which may be formed in a substantial ring of any shape or size and the vertical member 16/15 could be a cylinder having a circular cross-section or could be in geometrical shape.

FIG. 27 additionally illustrates tied down straps 141 to be used to tie down the trash container for easy disposal, and FIG. 27 illustrates an inflation/deflation device 143 to allow the frame 1000 to be inflated or deflated which may include an adjustable valve to seal and unseal the frame 1000.

FIG. 27 makes a point of showing a support area 167 which may or may not be inflated with frame 1000, declining down to a flexible or rigid support 107 declining possibly at a 1 degree angle to 90 degrees in relationship to the lowest floor to support area 007, and additionally holes or slits 163/161 will catch liquids or solids trapped between 107 and 007. Additionally, supports 107 and 007 may or may not have a liquid absorption material.

Figure 28:
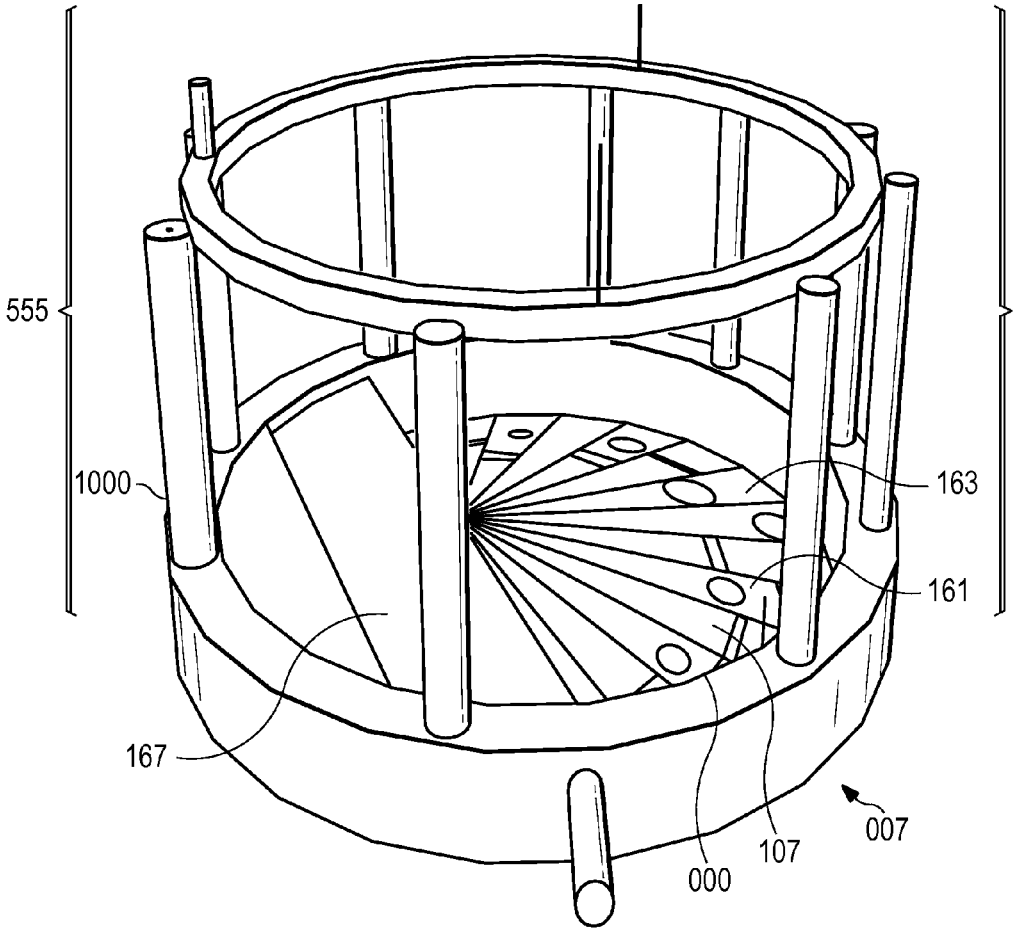
FIG. 28 illustrates a perspective view of the frame of the present invention, according to an example embodiment.

FIG. 28 illustrates the process of a liquid or solid being drained to 163 and 161 holes and slits 167 is the support area which may or may not be inflated with the frame 1000, the liquids can easily transformed to support 107, and trapped between 107 and 007, with possible liquid or solid absorption device.

Figure 29:
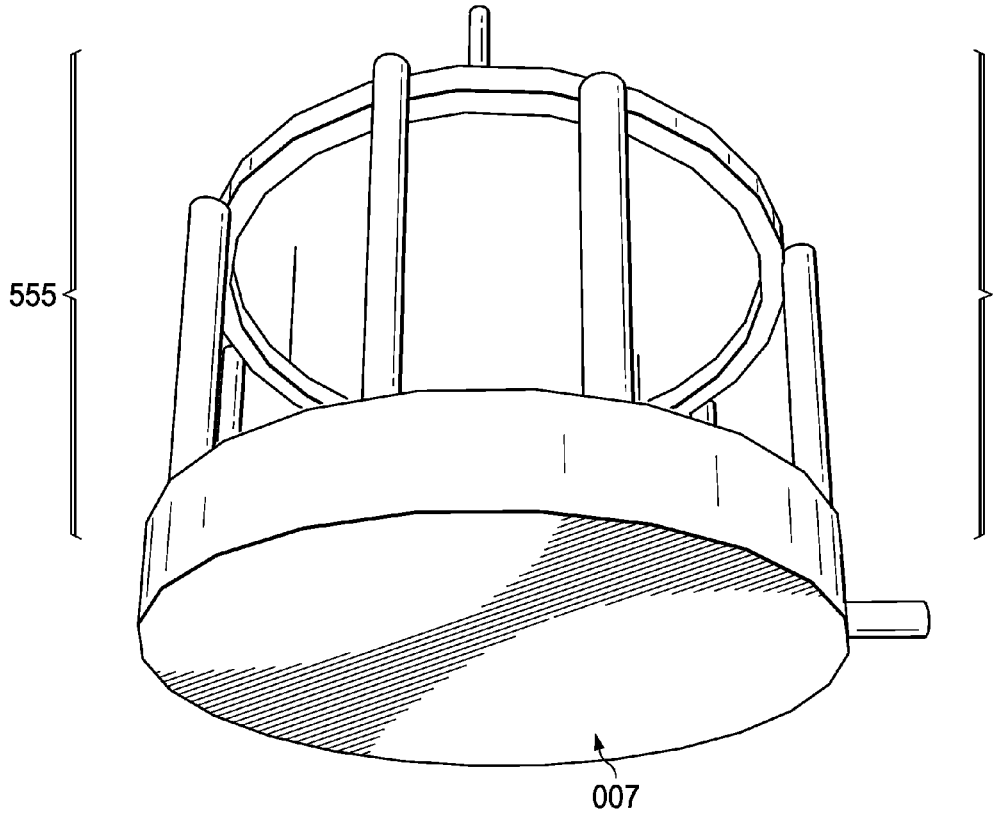
FIG. 29 illustrates a perspective view of the frame of the present invention, according to an example embodiment.

FIG. 29 illustrates the support 007, liquids and solids are trapped above 007 and below 107.

Figure 30:
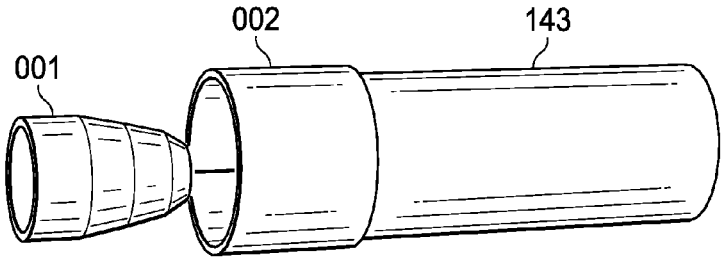
FIG. 30 illustrates a perspective view of the blow tube of the present invention, according to an example embodiment.

FIG. 30 shows a plug 001 and the blow tube 143 with end 002 which may or may not be rigid to allow for better air flow. A $CO_2$ or automatic electric air machine or other liquid or air devices may be used.

Figure 12A:
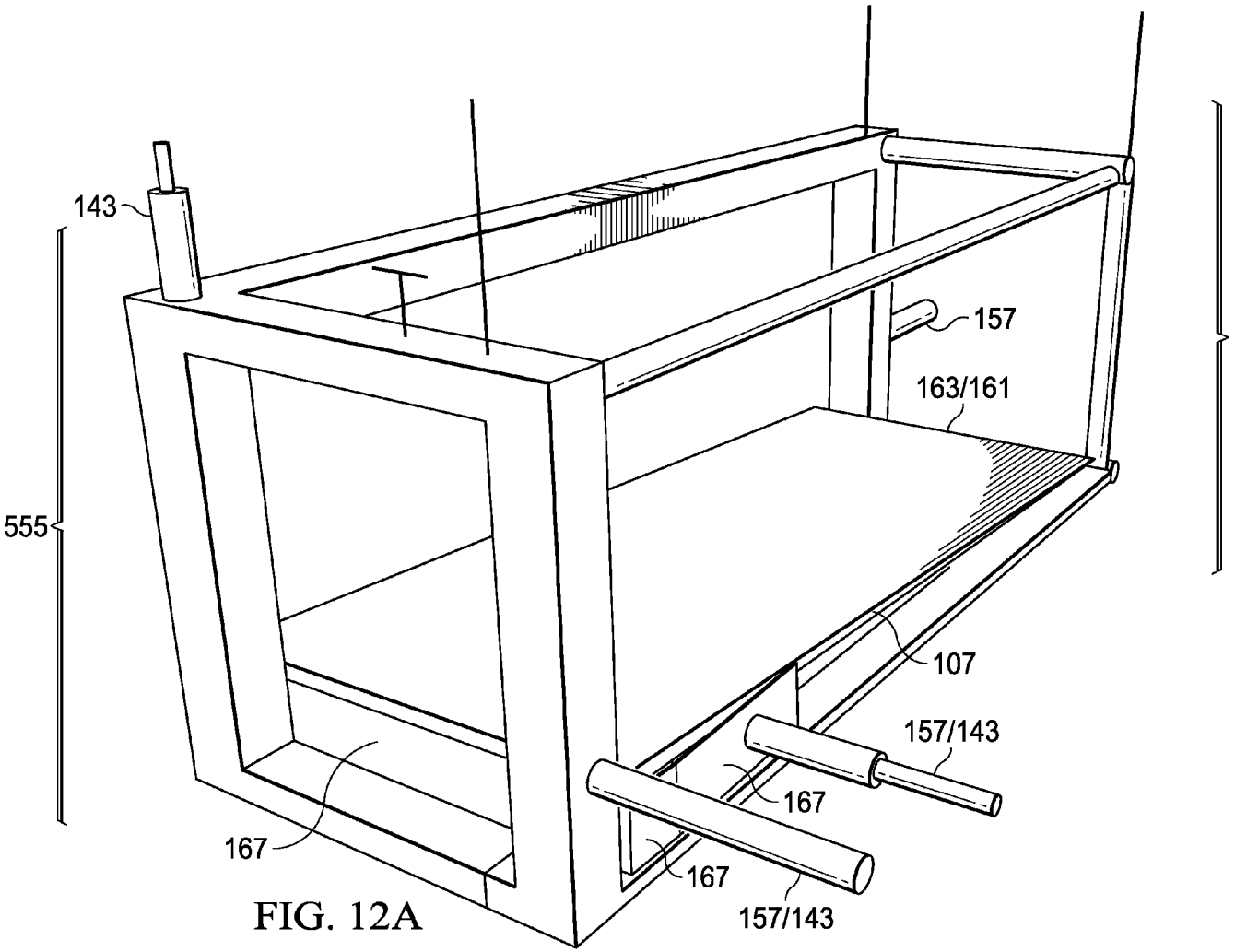
FIG. 12A illustrates a perspective view of the frame of the trash container of the present invention, according to an example embodiment.

FIG. 12A illustrates 167 a support system which may or may not be inflated by tubes 157/143.

FIG. 11A illustrates an absorption system that might be located in space, under rigid or non-rigid 107.

Figure 13A:
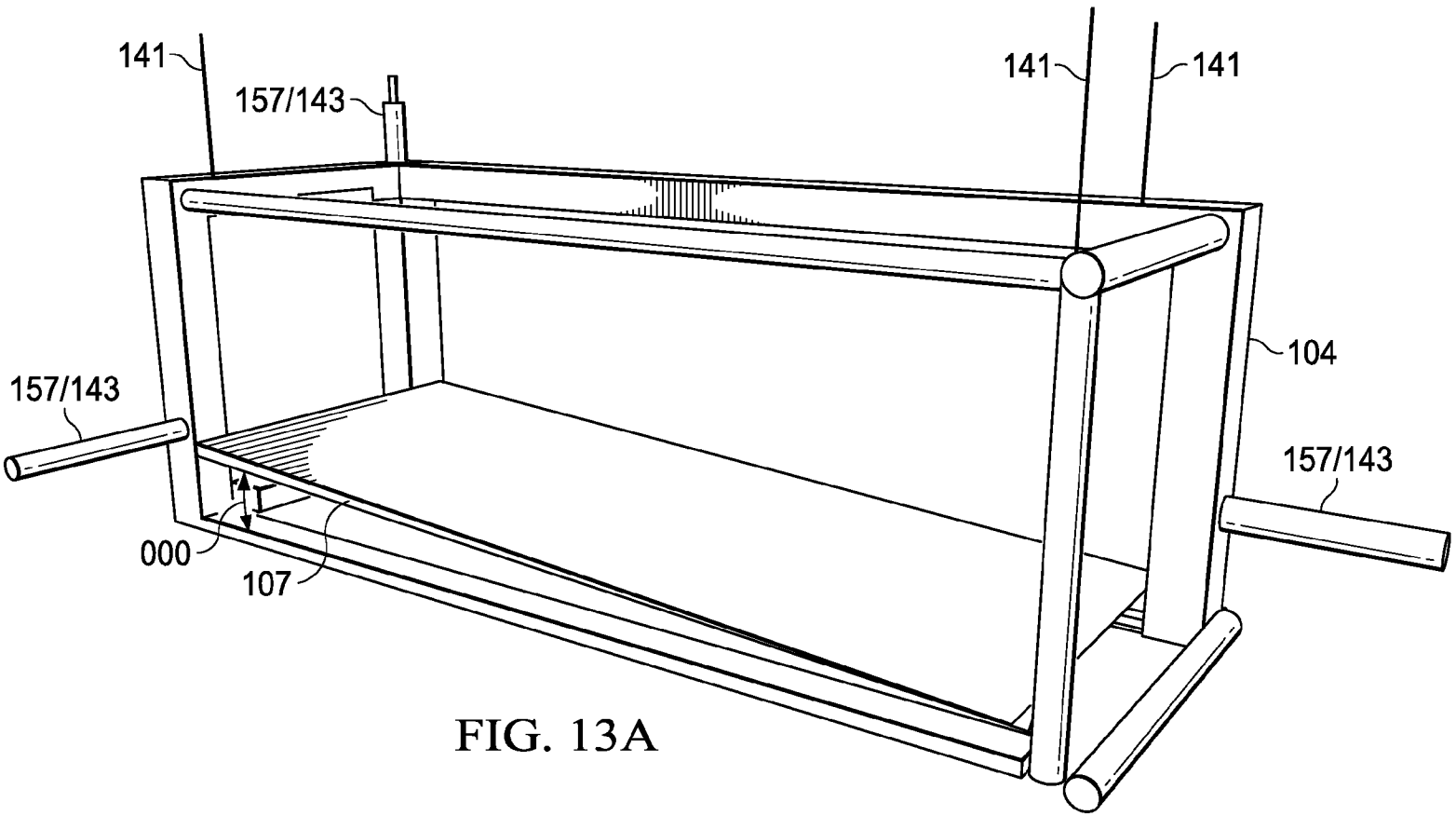
FIG. 13A illustrates a perspective view of the frame of the present invention, according to an example embodiment.

FIG. 13A show another angle of 000 in relation to 107.

Figure 31:
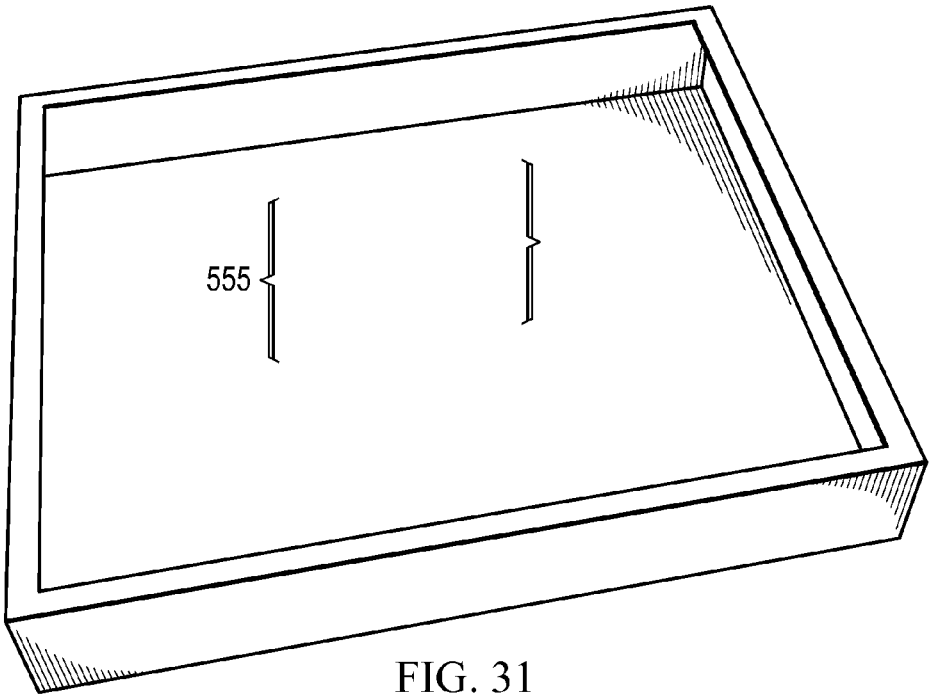
FIG. 31 illustrates another embodiment of the present invention, according to an example embodiment.

FIG. 31 illustrates the sheathing or outer covering of plastic or any other type material that will serve as a skin to hold trash.

Figure 32:
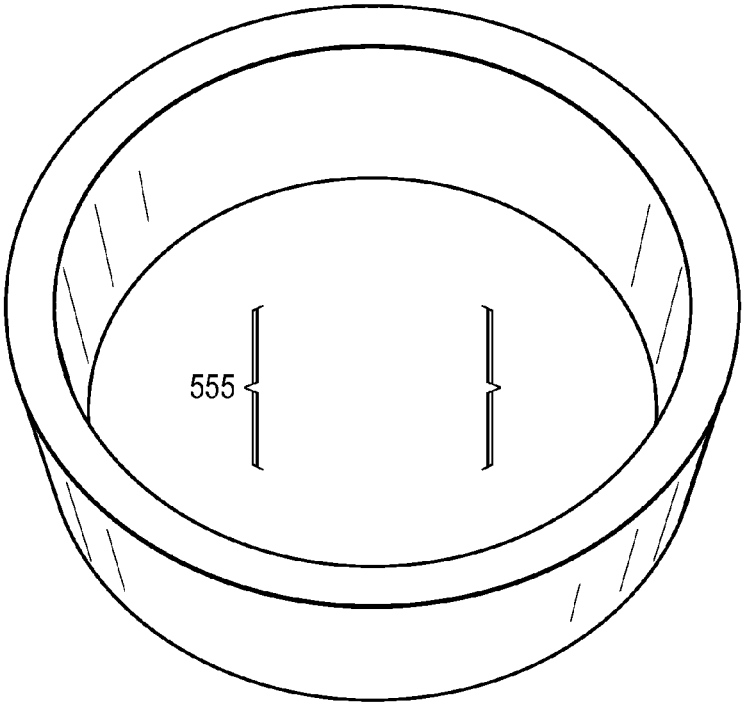
FIG. 32 illustrates another embodiment of the present invention, according to an example embodiment.

FIG. 32 is similar to FIG. 31, but this is to illustrate different shapes like circle or oval or other geometric shape.

FIG. 3 is missing the sheathing that goes around the blow up tubes to hold trash in place. Looking at FIGS. 1 and 2, the sheathing is in place. The opposing walls 105 and the walls 101 and 103 and the bottom wall 107. The sheathing was left off on purpose to show the inside of device without walls blocking the blow tubes.

In some embodiments, FIGS. 5-27 are the same as FIG. 3 for sheathing.

FIG. 16 should have a different sheathing that is round and a bottom sheathing to hold in cavity.

FIG. 17 should have a different sheathing that is round and a bottom sheathing to hold waste in cavity.

FIG. 18 should have a different sheathing that is round and a bottom sheathing to hold waste in cavity.

Referring back to FIGS. 1 and 2 collectively, a trash container 100 is illustrated that comprises an inflatable frame. Generally, the inflatable frame 109 comprises a plurality of vertical inflatable, tubular vertical members (four of the substantially vertical members 115) extending normally from a bottom wall 107. For example, the plurality of vertical inflatable, tubular vertical members includes four top periphery members, such as top periphery member 113, which are arranged in a rectangular configuration. The inflatable frame 109 also comprises a plurality of bottom frame members. For example, four bottom periphery members, such as bottom periphery member 111 can be arranged into a rectangular configuration. The bottom periphery members 111 are associated with the bottom wall 107 in some embodiments, and can be coupled with the plurality of vertical inflatable, tubular vertical members. According to some embodiments, plurality of bottom frame members (four of the bottom periphery members 111) are inflatable.

Also, the plurality of upper frame members (four of the top periphery members 113) can also couple with the plurality of vertical inflatable, tubular vertical members 115. The plurality of upper frame members 113 are inflatable and arranged to form an opening of an enclosure. For example, the plurality of upper frame members 113 define the opening of the trash container 100.

In some embodiments, the plurality of vertical inflatable, tubular vertical members 115, plurality of bottom frame members 111, and plurality of upper frame members 113 are arranged to form openings. According to some embodiments, a plurality of flexible wall panels, such as wall panel 105 are associated with the openings to form the enclosure.

In some embodiments, the plurality of vertical inflatable, tubular vertical members 115, plurality of bottom frame members 111, and plurality of upper frame members 113 are interconnected together in fluid communication.

In one embodiment an inflation/deflation device 143 for inflating/deflating the inflatable frame is provided on one of the plurality of upper frame members 113. A second inflation/deflation device can be coupled with the plurality of bottom frame members 111 and/or one of the plurality of vertical inflatable, tubular vertical members 115.

According to some embodiments, a plurality of tie downs, such as tie down 141 are associated with the plurality of upper frame members, such as upper frame member 113. In some embodiments, the plurality of vertical inflatable, tubular vertical members 115, the plurality of bottom frame members 111, and the plurality of upper frame members 113 are interconnected together in fluid communication. Thus, the inflatable frame 109 can be inflated by using the inflation/deflation device 143, which is associated with one component of the inflatable frame 109.

As best illustrated in FIG. 4, the plurality of upper frame members 113 are connected to the plurality of vertical inflatable, tubular vertical members 115 at right angles using rectangular members, such as rectangular member 151.

Some embodiments can include a release valve (see release valve 157 of FIG. 3) associated with the plurality of bottom frame members 111.

According to some embodiments, the bottom wall 107 comprises a wedge member (illustrated in FIG. 9). Embodiments illustrating wedge members include FIGS. 10-15 and 19-23. In some embodiments, the wedge member comprises rows of slits 163 that permit passage of fluid from within the enclosure, outwardly. The rows of slits 163 are offset from one another in some embodiments.

In accordance with the present disclosure, the trash container 100 can include a mat 150 that extends across the bottom wall 107. The bottom wall 107 has triangular sidewalls that cooperate with a back sidewall, as well as the mat 150 to create an example wedge member. In some embodiments, the mat is absorbent and configured to absorb liquids.

As illustrated in FIGS. 10-15, the bottom wall 107 can be inclined relative to the ground and forms a cavity with the plurality of bottom frame members. In some embodiments, one or more support plates, such as support plate 167 (see FIGS. 12 and 12A), extend between the plurality of bottom frame members and the inclined bottom wall 107. The one or more support plates are inflatable in some instances.

In additional embodiments, the bottom wall 107 is inclined and supported at opposing ends with inflatable floor supports, such as inflatable floor supports 169 illustrated in FIG. 15. These supports are disposed at the corners of the bottom wall 107, as an example configuration.

Some embodiments include cylindrical inflatable supports, such as in FIG. 26. In these embodiments, one of the plurality of bottom frame members, such as frame member 1902 can be enlarged to form a back cylinder support such that the bottom wall 1903 is inclined when coupled with the bottom frame members (1901 and 1902).

Some embodiments, such as trash containers of FIGS. 27-29 include inflatable cylindrical rings, such as a bottom periphery member 16/11 of FIG. 27. A plurality of vertical inflatable, tubular vertical members (such as 16/15) are coupled to the inflatable ring 16/11.

In some embodiments, an upper frame ring 16/13 is included and is also inflatable. The upper frame ring 16/13 forms an opening of an enclosure. Wall panels and an inflation/deflation device can be included as well. In some embodiments, the inflation/deflation device comprises an adjustable valve.

In some embodiments, a bottom wall has a support area and a plurality of pie wedge sections 107 that are angled downwardly away from the support area. A portion of the plurality of pie wedge sections can comprise slits or holes 163/161 for providing fluid communication from inside the enclosure.

The trash container can include a support area 007. The support area and the plurality of pie wedge sections are spaced apart from the lowest floor to form a space. In some embodiments, a liquid absorbing material is disposed in the space.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The invention claimed is:

1. A trash container, comprising:

an inflatable frame comprising:

a plurality of vertical inflatable, tubular vertical members extending normally from a bottom wall;

a plurality of bottom frame members associated with the bottom wall and coupled with the plurality of vertical inflatable, tubular vertical members, wherein the plurality of bottom frame members are inflatable;

a plurality of upper frame members coupled with the plurality of vertical inflatable, tubular vertical members, wherein the plurality of upper frame members are inflatable and arranged to form an opening of an enclosure; and the plurality of vertical inflatable, tubular vertical members, plurality of bottom frame members, and plurality of upper frame members are arranged to form openings;

a plurality of flexible wall panels associated with the openings to form the enclosure; and an inflation/deflation device for inflating/deflating the inflatable frame.

2. The trash container according to claim 1, further comprising a plurality of tie downs associated with the plurality of upper frame members.

3. The trash container according to claim 1, wherein the plurality of vertical inflatable, tubular vertical members, the plurality of bottom frame members, and the plurality of upper frame members are interconnected together in fluid communication.

4. The trash container according to claim 1, wherein the plurality of upper frame members are connected to the plurality of vertical inflatable, tubular vertical members at right angles using rectangular members.

5. The trash container according to claim 1, wherein the plurality of bottom frame members are connected to the plurality of vertical inflatable, tubular vertical members at right angles using rectangular members.

6. The trash container according to claim 1, further comprising a second inflator/deflator device coupled with the plurality of bottom frame members.

7. The trash container according to claim 6, further comprising a release valve associated with the plurality of bottom frame members.

8. The trash container according to claim 1, wherein the bottom wall comprises a wedge member.

9. The trash container according to claim 8, wherein the wedge member comprises rows of slits that permit passage of fluid from within the enclosure, outwardly.

10. The trash container according to claim 9, wherein the rows of slits are offset from one another.

11. The trash container according to claim 8, further comprising a mat that extends across the bottom wall.

12. The trash container according to claim 11, wherein the mat is absorbent.

13. The trash container according to claim 1, wherein the bottom wall is inclined and forms a cavity with the plurality of bottom frame members.

14. The trash container according to claim 13, further comprising one or more support plates extending between the plurality of bottom frame members and the inclined bottom wall.

15. The trash container according to claim 14, wherein the one or more support plates are inflatable.

16. The trash container according to claim 1, wherein the bottom wall is inclined and supported at opposing ends with inflatable floor supports.

17. The trash container according to claim 1, wherein one of the plurality of bottom frame members is enlarged to form a back cylinder support such that the bottom wall is inclined when coupled with the bottom frame members.

18. A trash container, comprising:

an inflatable frame comprising:

a plurality of vertical inflatable, tubular vertical members extending normally from a bottom wall;

a bottom frame ring associated with the bottom wall and coupled with the plurality of vertical inflatable, tubular vertical members, wherein the bottom frame ring is inflatable;

an upper frame ring associated the plurality of vertical inflatable, tubular vertical members, wherein the upper frame ring is inflatable, wherein the upper frame ring forms an opening of an enclosure; and the plurality of vertical inflatable, tubular vertical members, the bottom frame ring, and the upper frame ring are arranged to form openings;

a plurality of flexible wall panels associated with the openings to form the enclosure; and an inflation/deflation device for inflating/deflating the inflatable frame.

19. The trash container according to claim 18, wherein the inflation/deflation device comprises an adjustable valve.

20. The trash container according to claim 18, wherein the bottom wall is comprised of a support area and a plurality of pie wedge sections that are angled downwardly away from the support area.

21. The trash container according to claim 20, wherein a portion of the plurality of pie wedge sections comprises slits or holes for providing fluid communication from inside the enclosure.

22. The trash container according to claim 21, further comprising a lowest floor, wherein the support area and the plurality of pie wedge sections are spaced apart from the lowest floor to form a space.

23. The trash container according to claim 22, further comprising a liquid absorbing material disposed in the space.

* * * * *